US008144091B2

(12) United States Patent
Nose

(10) Patent No.: US 8,144,091 B2
(45) Date of Patent: Mar. 27, 2012

(54) LIQUID CRYSTAL DISPLAY ELEMENT, DRIVING METHOD OF THE SAME, AND ELECTRONIC PAPER HAVING THE SAME

(75) Inventor: Masaki Nose, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 1013 days.

(21) Appl. No.: 12/105,812

(22) Filed: Apr. 18, 2008

(65) Prior Publication Data

US 2008/0259015 A1 Oct. 23, 2008

(30) Foreign Application Priority Data

Apr. 20, 2007 (JP) ..... 2007-111523

(51) Int. Cl.
*G09G 3/36* (2006.01)

(52) U.S. Cl. ..... 345/87; 345/89; 345/690

(58) Field of Classification Search ..... 345/87–102, 345/204, 690

See application file for complete search history.

(56) References Cited

U.S. PATENT DOCUMENTS

| | | | | |
|---|---|---|---|---|
| 6,133,895 | A * | 10/2000 | Huang | 345/94 |
| 6,414,666 | B1 | 7/2002 | Yamakawa et al. | |
| 6,812,913 | B2 | 11/2004 | Masazumi et al. | |
| 6,927,765 | B1 | 8/2005 | Masazumi et al. | |
| 7,038,648 | B2 | 5/2006 | Yamakawa et al. | |
| 2002/0109661 | A1 * | 8/2002 | Blackson et al. | 345/97 |
| 2008/0024412 | A1 | 1/2008 | Nose | |
| 2009/0161034 | A1 * | 6/2009 | Coates et al. | 349/35 |
| 2009/0189847 | A1 * | 7/2009 | Hughes et al. | 345/103 |
| 2009/0303259 | A1 * | 12/2009 | Shalom et al. | 345/690 |

FOREIGN PATENT DOCUMENTS

| | | | |
|---|---|---|---|
| JP | 2000-2869 | A | 1/2000 |
| JP | 2000-147466 | A | 5/2000 |
| JP | 2000-171837 | A | 6/2000 |
| JP | 2001-228459 | A | 8/2001 |
| JP | 2003-228045 | A | 8/2003 |
| WO | 2005/122124 | A1 | 12/2005 |
| WO | 2006/103738 | A1 | 10/2006 |

OTHER PUBLICATIONS

Nam-Seok Lee et al; "A Novel Dynamic Drive Scheme for Reflective Cholesteric Displays," P-89; 2002; SID 02 Digest; pp. 546-549.

(Continued)

*Primary Examiner* — Amare Mengistu
*Assistant Examiner* — Hong Zhou
(74) *Attorney, Agent, or Firm* — Westerman, Hattori, Daniels & Adrian, LLP; Scott M. Daniels

(57) ABSTRACT

A method of driving a liquid crystal display element includes a first step for initializing a liquid crystal in a pixel and displaying an initial grayscale at the pixel and a second step for displaying a desired grayscale lower than the initial grayscale by making a cumulative time difference between low grayscales lower than a reference grayscale longer than a cumulative time difference between high grayscales higher than the reference grayscale, where the cumulative time differences are a difference between a cumulative voltage application time of voltage pulses cumulatively applied to display a grayscale lower than the initial grayscale and a cumulative voltage application time of the voltage pulses cumulatively applied to display a grayscale one level lower than the grayscale lower than the initial grayscale.

20 Claims, 21 Drawing Sheets

OTHER PUBLICATIONS

Y.-M. Zhu et al; "Cumulative Drive Schemes for Bistable Reflective Cholesteric LCDs," P-82; 1998; SID 98 Digest; pp. 798-801.

European Search Report dated Jun. 7, 2010, issued in corresponding European Patent Application No. 08154364.7.

Y. M. Zhu et al., "P-82: Cumulative Drive Schemes for Bistable Reflective Cholesteric LCDs"; 1998 SID International Symposium—May 17-22, 1998, Anaheim, California, May 17, 1998, XP007008807.

* cited by examiner

FIG. 9

| | SELECTION PERIOD | | NON-SELECTION PERIOD | |
|---|---|---|---|---|
| | FIRST HALF | SECOND HALF | FIRST HALF | SECOND HALF |
| DATA ELECTRODE DRIVING CIRCUIT | 36V | 0V | 0V | 0V |
| SCAN ELECTRODE DRIVING CIRCUIT | 0V | 36V | 0V | 0V |
| LIQUID CRYSTAL | 36V | −36V | 0V | 0V |

FIG. 12

| | SELECTION PERIOD | | NON-SELECTION PERIOD | |
|---|---|---|---|---|
| | FIRST HALF | SECOND HALF | FIRST HALF | SECOND HALF |
| DATA ELECTRODE DRIVING CIRCUIT | 20V | 0V | 20V | 0V |
| SCAN ELECTRODE DRIVING CIRCUIT | 0V | 20V | 10V | 10V |
| LIQUID CRYSTAL | 20V | −20V | 10V | −10V |

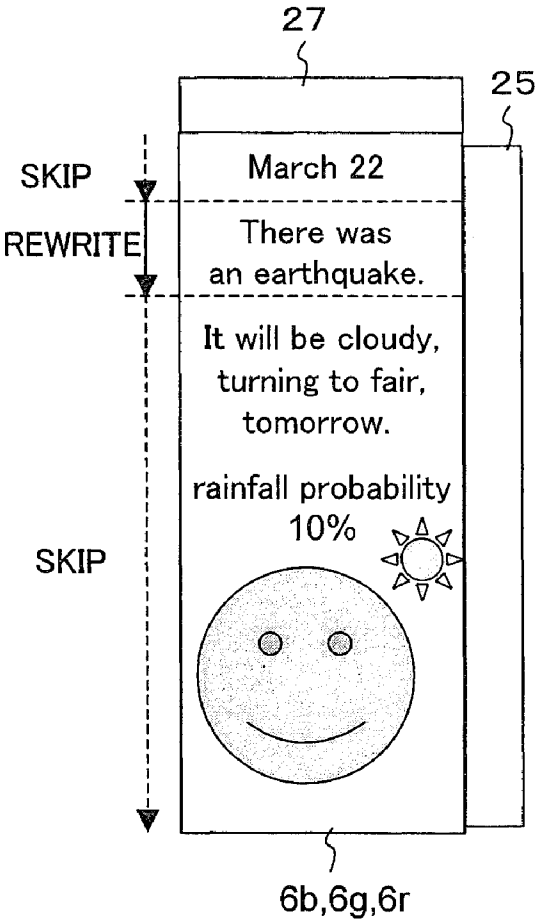
FIG. 17A
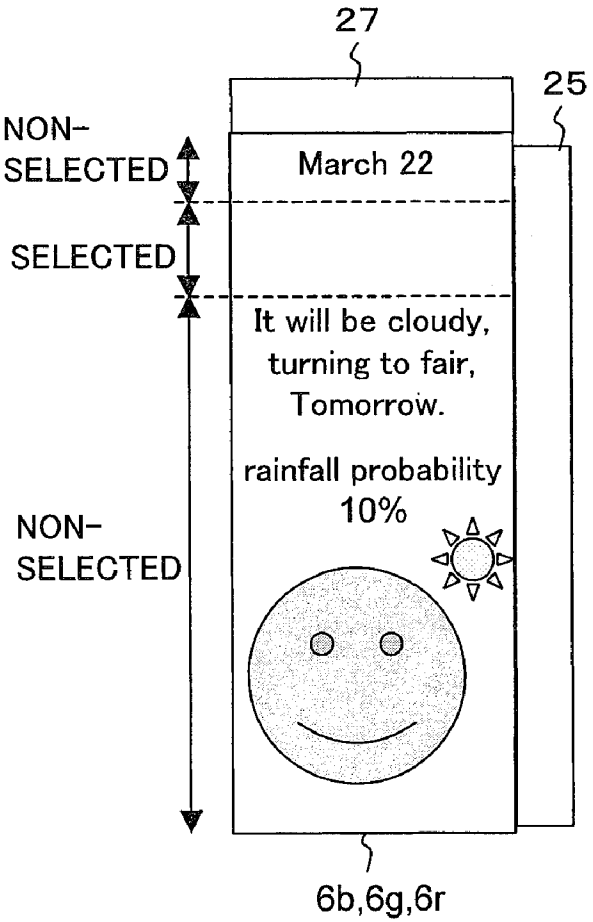
FIG. 17B
FIG. 17C

LIQUID CRYSTAL DISPLAY ELEMENT, DRIVING METHOD OF THE SAME, AND ELECTRONIC PAPER HAVING THE SAME

BACKGROUND OF THE INVENTION

1. Field of the Invention

The present invention relates to a liquid crystal display element for displaying images by driving a liquid crystal, a driving method of the element, and an electronic paper having the element.

2. Description of the Related Art

Recently, the development of an electronic paper is active in various enterprises and universities. Promising fields of application of the electronic paper include the field of an electronic books first of all and include the field of portable apparatus such as sub-displays of mobile terminals and IC card display units or the like. One type of display elements used in an electronic paper is liquid crystal display elements using a liquid crystal composition in which a cholesteric phase is formed (such a composition is called "a cholesteric liquid crystal" or "a chiral nematic liquid crystal" and hereinafter referred to as "a cholesteric liquid crystal"). A cholesteric liquid crystal has excellent characteristics such as semi-permanent display content holding properties (memory characteristics), vivid color display, high contrast, and high resolution.

Patent Document 1: JP-A-2001-228459

Patent Document 2: JP-A-2003-228045

Patent Document 3: JP-A-2000-2869

Patent Document 4: JP-A-2000-147466

Patent Document 5: JP-A-2000-171837

Patent Document 6: International Patent Publication No. 06/103,738 Pamphlet

Non-Patent Document 1: Nam-Seok Lee, Hyun-Soo Shin, etc., A novel Dynamic Drive Scheme for Reflective Cholesteric Displays, SID 02 DIGEST, pp. 546-549, 2002

Non-Patent Document 2: Y.-M. Zhu, D.-K. Yang, Cumulative Drive Schemes for Bistable Reflective Cholesteric LCDs, SID 98 DIGEST, pp. 798-801, 1998

A description will now be made on the documents on the related art disclosing methods of multi-grayscale display utilizing cholesteric liquid crystals and problems of those methods.

For example, Patent Documents 1 and 2 disclose methods called dynamic driving in which intermediate grayscales are displayed using amplitudes, pulse widths, or phase differences in a selection section among three sections of a driving waveform, i.e., a preparation section, a selection section, and an evolution section. Although such dynamic driving methods allow driving at a high speed, a problem arises in that intermediate grayscales have high granularity.

In general, dynamic driving requires dedicated driving devices (drivers) to allow a multiplicity of voltages to be output, and a cost increase can result from the fabrication of the drivers and the complicatedness of a driver control circuit.

Non-Patent Document 1 discloses a dynamic driving method which is implemented using inexpensive general-purpose STN drivers. However, the elimination of high granularity constituting a problem of dynamic driving cannot be expected from the method.

Patent Document 3 discloses a method having the steps of applying a first pulse to a liquid crystal to put it in a homeotropic state and applying second and third pulses immediately after the first pulse to display a desired grayscale using a potential difference between the second and third pulses. According to this driving method, the concern about the granularity of intermediate grayscales remains, and another problem arises in that an element cannot be manufactured with an inexpensive configuration because a high driving voltage is required.

All of the above-described driving methods according to the related art are driving methods utilizing an intermediate grayscale region B as shown in FIG. 4 which will be described later. Therefore, the methods have a problem with display quality because of significant granularity of images obtained thereby, although they allow driving at a high speed. A driving method utilizing an intermediate grayscale region A as shown in FIG. 4 is disclosed in Non-Patent Document 2, and the method still has a problem.

Non-Patent Document 2 discloses a method which utilizes cumulative response (overwrite) characteristics unique to liquid crystals to drive a liquid crystal from the planar state to the focal conic state or from the focal conic state to the planar state gradually at a high speed on the order of the rate of quasi moving pictures by applying relatively short pulses to the liquid crystal.

However, this method requires a driving voltage as high as 50 to 70 V to perform driving at such a relatively high speed, and it can therefore result in a cost increase. Further, the method which is referred to as "two phase cumulative drive scheme" involves two stages, i.e., "a preparation phase" and "a selection phase". Since responses in two directions, i.e., cumulative responses toward the planar state and cumulative responses toward the focal conic state (the intermediate grayscale region A and the intermediate grayscale region B) are used at those phases, respectively, a problem in display quality arises.

Patent Documents 4 and 5 disclose methods including the use of a fast forward mode which takes advantage of resetting to the focal conic state. Although such a method provides relatively high contrast compared to the above-described methods, writing after a reset requires a high voltage which is difficult to supply using general-purpose STN drivers. Further, such a method has a problem in that it results in increased cross-talks to half-selected or non-selected pixels because grayscales are written in a cumulative manner during the focal conic state to the planar state.

Patent Document 6 discloses a method which takes advantage of cumulative responses (overwrites) of a liquid crystal to achieve multi-grayscale display having high uniformity with a liquid crystal display element using inexpensive general-purpose drivers having a low breakdown voltage. According to this method, a voltage pulse is applied to a liquid crystal layer a plurality of times to vary a driving voltage and a pulse width stepwise, whereby the liquid crystal is controlled to change from an initial state that is a reflective state to a predetermined intermediate grayscale state using a region having a great margin (intermediate grayscale region A). Since any increase in the driving voltage can be consequently avoided, the method can be implemented using inexpensive general purpose drivers which have a low breakdown voltage and which provide binary outputs. Further, since this method allows gray level conversion utilizing a region having a great margin, multi-grayscale display can be achieved with high uniformity. However, this method has following problems.

A first problem is that blurs and ghosts can occur on a display screen. Since a reset voltage of a resetting unit used in this method depends on image data to be displayed, the resetting effect varies from pixel to pixel. As a result, displayed characters may be blurred, and ghosts may appear.

A second problem is that a grayscale jump can occur when low grayscales are displayed. According to this display method, there is a great difference in brightness between the lowest grayscale (black) and the grayscale one level higher than the lowest grayscale, and a problem arises in that grayscale jumps are noticeable when the low grayscales are displayed. According to this method, white and black are written at the first scan, and intermediate grayscales are written at the subsequent scans by applying short pulses in a cumulative manner. However, cumulative response is degraded for low grayscales. This results in a great difference in brightness between the lowest grayscale and the grayscale one level higher than the lowest grayscale which is written by applying a voltage pulse of ±20 V to the liquid crystal layer.

A third problem is an increase in rewriting time. The display method according to the related art requires a resetting time of 5.4 seconds and a grayscale writing time of 6.9 seconds, for example, in the case of a screen having XGA resolution. Therefore, displayed content cannot be recognized for at least 5.4 seconds until resetting is completed. Under the circumstance, there are demands for a novel display method which enables display within about 2 seconds even if there is some reduction in contrast.

SUMMARY OF THE INVENTION

According to one aspect of an embodiment, a method of driving a liquid crystal display element includes a first step for initializing a liquid crystal in a pixel and displaying an initial grayscale at the pixel and a second step for displaying a desired grayscale lower than the initial grayscale by making a cumulative time difference between low grayscales lower than a reference grayscale longer than a cumulative time difference between high grayscales higher than the reference grayscale, where the cumulative time differences are a difference between a cumulative voltage application time of voltage pulses cumulatively applied to display a grayscale lower than the initial grayscale and a cumulative voltage application time of the voltage pulses cumulatively applied to display a grayscale one level lower than the grayscale lower than the initial grayscale.

According to another aspect of an embodiment, a liquid crystal display element includes a liquid crystal enclosed between a pair of substrates, a pixel including the liquid crystal and a pair of electrodes sandwiching the liquid crystal, and a driving device for displaying a multiplicity of grayscales by performing a first step for initializing the liquid crystal in the pixel and displaying an initial grayscale at the pixel and a second step for displaying a desired grayscale lower than the initial grayscale by making a cumulative time difference between low grayscales lower than a reference grayscale longer than a cumulative time difference between high grayscales higher than the reference grayscale, where the cumulative time differences are a difference between a cumulative voltage application time of voltage pulses cumulatively applied to display a grayscale lower than the initial grayscale and a cumulative voltage application time of the voltage pulses cumulatively applied to display a grayscale one level lower than the grayscale lower than the initial grayscale.

According to another aspect of an embodiment, there is an electronic paper including a liquid crystal display element according to the invention.

BRIEF DESCRIPTION OF THE DRAWINGS

FIG. 9 shows values of various voltages used at the first step S1 of the method of driving the liquid crystal display element 1 according to the embodiment of the invention;

FIG. 12 shows voltage values of various voltages output at the second step S2 of the method of driving the liquid crystal display element 1 according to the embodiment of the invention;

FIGS. 17A to 17C schematically show content displayed on the screen of a liquid crystal display element according to Modification 2 of the embodiment of the invention;

DESCRIPTION OF THE PREFERRED EMBODIMENT

Figure 20:
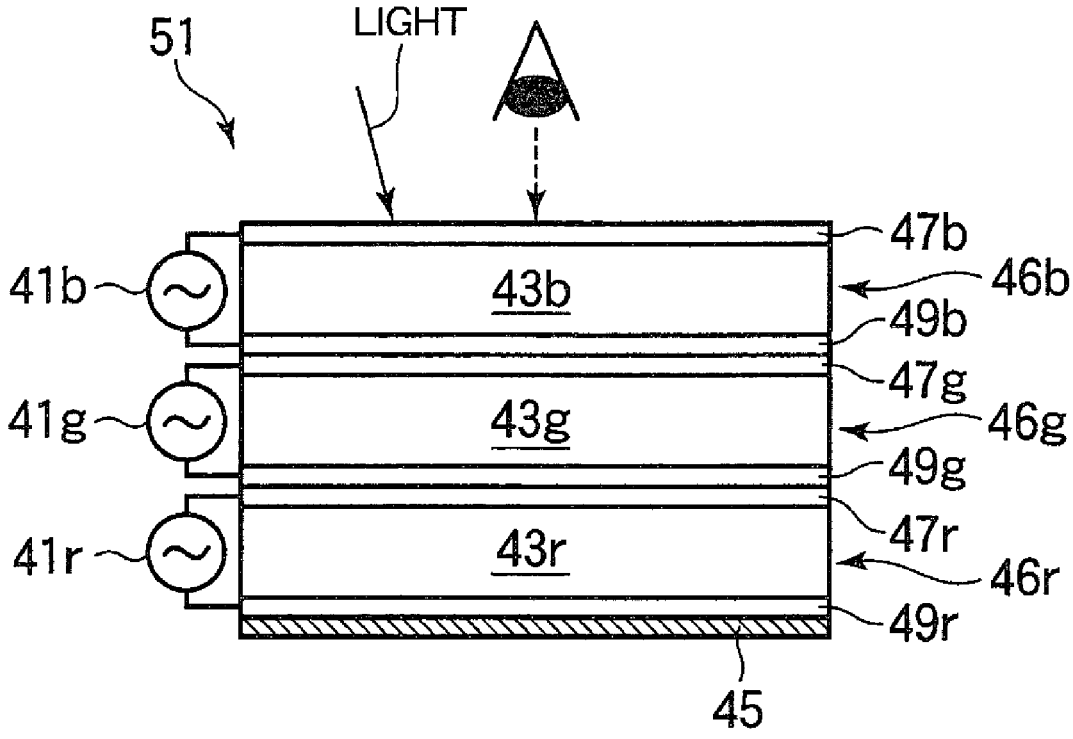
FIG. 20 schematically shows a sectional configuration of a liquid crystal display element capable of full-color display.

FIG. 20 schematically shows a sectional configuration of a liquid crystal display element 51 capable of full-color display using a cholesteric liquid crystal. The liquid crystal display element 51 has a structure in which a blue (B) display section 46*b*, a green (G) display section 46*g*, and a red (R) display section 46*r* are stacked in the order listed from a display surface of the element. In the illustration, the side of the element where a upper substrate 47*b* is located is the display surface, and outside light (represented by the arrow in a solid line) incidents on the display surface from above the substrate 47*b*. An eye of a viewer and a viewing direction from the same (indicated by the arrow in a broken line) are schematically shown above the substrate 47*b*.

The B display section 46*b* includes a liquid crystal layer 43*b* for blue (B) enclosed between a pair of the upper substrate 47*b* and a lower substrate 49*b*, and a pulse voltage source 41*b* for applying predetermined pulse voltages to the B liquid crystal layer 43*b*. The G display section 46*g* includes a liquid crystal layer 43*g* for green (G) enclosed between a pair of an upper substrate 47*g* and a lower substrate 49*g*, and a pulse voltage source 41*g* for applying predetermined pulse voltages to the G liquid crystal layer 43*g*. The R display section 46*r* includes a liquid crystal layer 43*r* for red (R) enclosed between a pair an upper substrate 47*r* and a lower substrate 49*r*, and a pulse voltage source 41*r* for applying predetermined pulse voltages to the R liquid crystal layer 43*r*. A light absorption layer 45 is disposed on a back side of the lower substrate 49*r* of the R display section 46*r*.

A cholesteric liquid crystal used in each of the B, G, and R liquid crystal layers 43*b*, 43*g*, and 43*r* is a liquid crystal mixture obtained by adding a relatively great amount of chiral additive (also called a chiral material) to a nematic liquid crystal such that the liquid crystal has a chiral content of several tens % by weight. When a relatively great amount of chiral material is included in a nematic liquid crystal, a cholesteric phase that is a great helical twist of nematic liquid crystal molecules can be formed.

A cholesteric liquid crystal has bi-stability (memory characteristics), and the liquid crystal can be put in any of a planar state, a focal conic state, and an intermediate state that is a mixture of the planar and focal conic states by adjusting the intensity of an electric field applied to the same. Once the liquid crystal enters the planar state, the focal conic state, or the intermediate state that is the mixture of those states, it thereafter stays in that state with stability even if the electric field is removed.

When a predetermined high voltage is applied between upper and lower substrates 47 and 49 to apply an intense electric field to a liquid crystal layer 43, helical structures of liquid crystal molecules are completely decomposed, and all liquid crystal molecules enter a homeotropic state in which they are aligned according to the direction of the electric field. When the electric field is abruptly made zero in the homeotropic state, the helical axes of the liquid crystal molecules become perpendicular to substrate surfaces of the upper and lower substrates 47 and 49. As a result, the liquid crystal layer 43 enters the planar state in which beams of light in accordance with the helical pitch are selectively reflected. On the contrary, a predetermined voltage, for example, lower than the above-mentioned high voltage is applied between the upper and lower substrates 47 and 49 to apply such a low electric field that the helical structures of liquid crystal molecules will not be decomposed to the liquid crystal layer 43 and that the electric field is thereafter abruptly made zero, then, the helical axes of liquid crystal molecules will be directed in parallel with the substrate surfaces with the upper and lower substrates 47 and 49. As a result, the liquid crystal layer 43 enters the focal conic state in which it transmits light incident thereon. The focal conic state can be also obtained by applying an intense electric field to the liquid crystal layer 43 and by thereafter removing the electric field slowly.

For example, the intermediate state that is a mixture of the planar state and the focal conic state can be obtained by applying a voltage lower than the voltage for obtaining the focal conic state between the upper and lower substrates 47 and 49 to apply an electric field to the liquid crystal layer 43 and by thereafter making the electric field abruptly zero. Information is displayed utilizing this phenomenon.

Figure 21A:
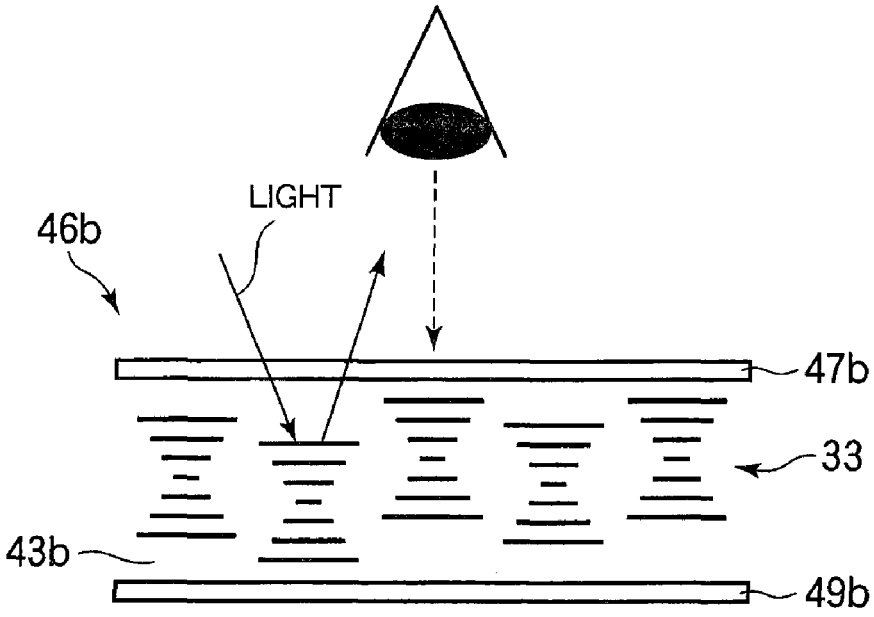
FIGS. 21A and 21B are illustrations schematically showing a sectional configuration of one liquid crystal layer of the liquid crystal display element.
Figure 21B:
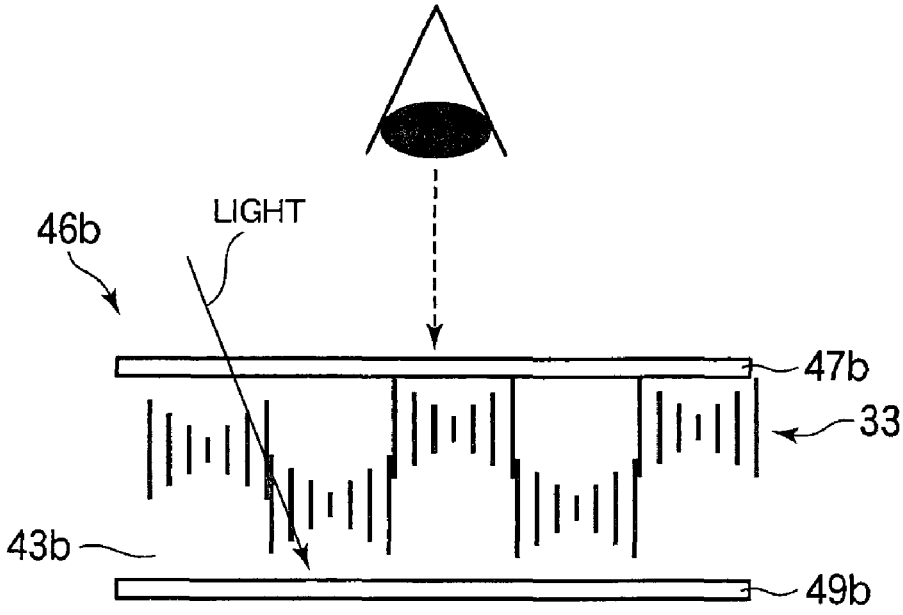

FIGS. 21A and 21B are illustrations for explaining a principle of display performed by the liquid crystal display element 51 using such cholesteric liquid crystals. In FIGS. 21A and 21B, the B display section 46*b* is shown as an example to explain the display principle of the liquid crystal display element 51. FIG. 21A shows the alignment of liquid crystal molecules 33 of the cholesteric liquid crystal observed when the B liquid crystal layer 43*b* of the B display section 46*b* is in the planar state. As shown in FIG. 21A, in the planar state, the liquid crystal molecules 33 are sequentially rotated in the thickness direction of the substrates to form helical structures, and the helical axes of the helical structures are substantially perpendicular to the substrate surfaces.

In the planar state, beams of light in a predetermined wavelength band in accordance with the helical pitch of the liquid crystal molecules 33 are selectively reflected at the liquid crystal layer. At this time, the reflected light beams are circularly polarized beams which are either right-handed or left-handed depending on the chirality of the helical pitch, and other types of light are transmitted. Since natural light is a mixture of left and right circularly polarized beams, when natural light incidents on the liquid crystal layer in the planar state, it can be assumed that 50% of the incident light is reflected and 50% of the incident light transmitted in a predetermined wavelength band. A wavelength $\lambda$ at which the greatest reflection takes place is given by $\lambda = n \cdot p$ where n represents the average refractive index of the liquid crystal layer and p represents the helical pitch. A reflection band $\Delta\lambda$ becomes greater with refractive index anisotropy $\Delta n$ of the liquid crystal.

Therefore, in order that blue light will be selectively reflected at the B liquid crystal layer 43*b* of the B display section 46*b* in the planar state, the average refractive index n and the helical pitch p are set, for example, such that $\lambda = 480$ nm will be true. The average refractive index n can be adjusted by selecting the liquid crystal material and the chiral material, and the helical pitch p can be adjusted by adjusting the chiral material content.

FIG. 21B shows the alignment of the liquid crystal molecules 33 of the cholesteric liquid crystal observed when the B liquid crystal layer 43*b* of the B display section 46*b* is in the focal conic state. As shown in FIG. 21B, in the focal conic state, the liquid crystal molecules 33 are sequentially rotated in in-plane directions of the substrates to form helical structures, and the helical axes of the helical structures are substantially parallel to the substrate surfaces. In the focal conic state, the B liquid crystal layer 43*b* loses selectivity of wavelengths to be reflected, and most of incident beams are transmitted by the layer. Since transmitted beams are absorbed by the light absorption layer 45 disposed on the back side surface of the lower substrate 49*r* of the R display section 46*r*, a dark state (black) can be displayed.

In the intermediate state that is a mixture of the planar state and the focal conic state, the ratio between reflected light and transmitted light is adjusted according to the ratio between the planar state and the focal conic state exists, and the intensity of reflected light varies accordingly. It is therefore possible to perform multi-grayscale display according to the intensity of reflected light.

As thus described, in a cholesteric liquid crystal, the quantity of reflected light can be controlled by a spirally twisted alignment of liquid crystal molecules 33. Cholesteric liquid crystals for selectively reflecting green and red light in the planar state are enclosed in the G liquid crystal layer 43*g* and the R liquid crystal layer 43*r*, respectively, in the same manner as for the B liquid crystal layer 43*b*. Thus, a liquid crystal display element 51 for full-color display is fabricated. The liquid crystal display element 51 has memory characteristics, and the element can therefore perform full-color display without consuming electric power except when the screen is rewritten.

Figure 1:
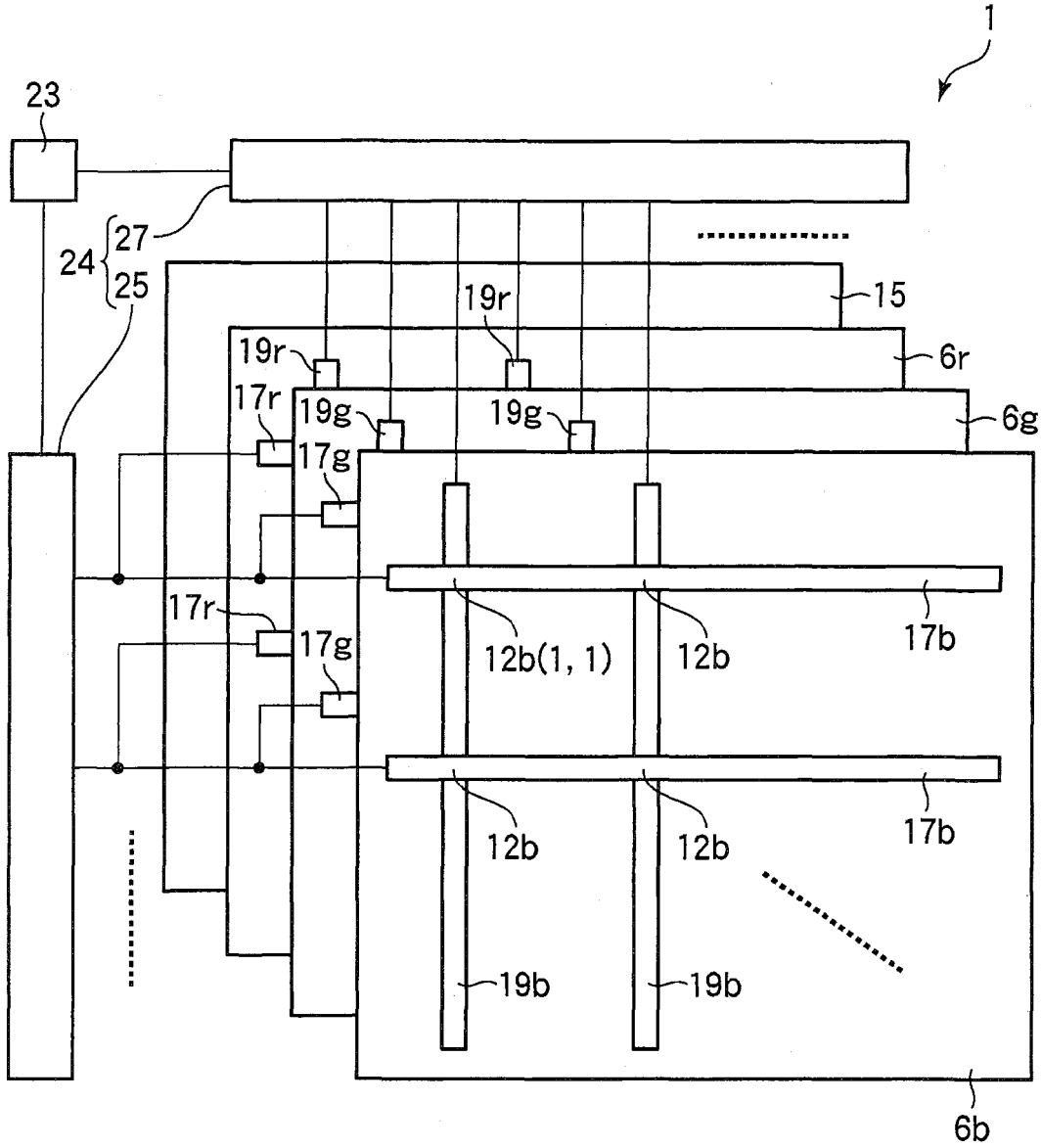
FIG. 1 shows a schematic configuration of a liquid crystal display element 1 according to an embodiment of the invention.
Figure 2:
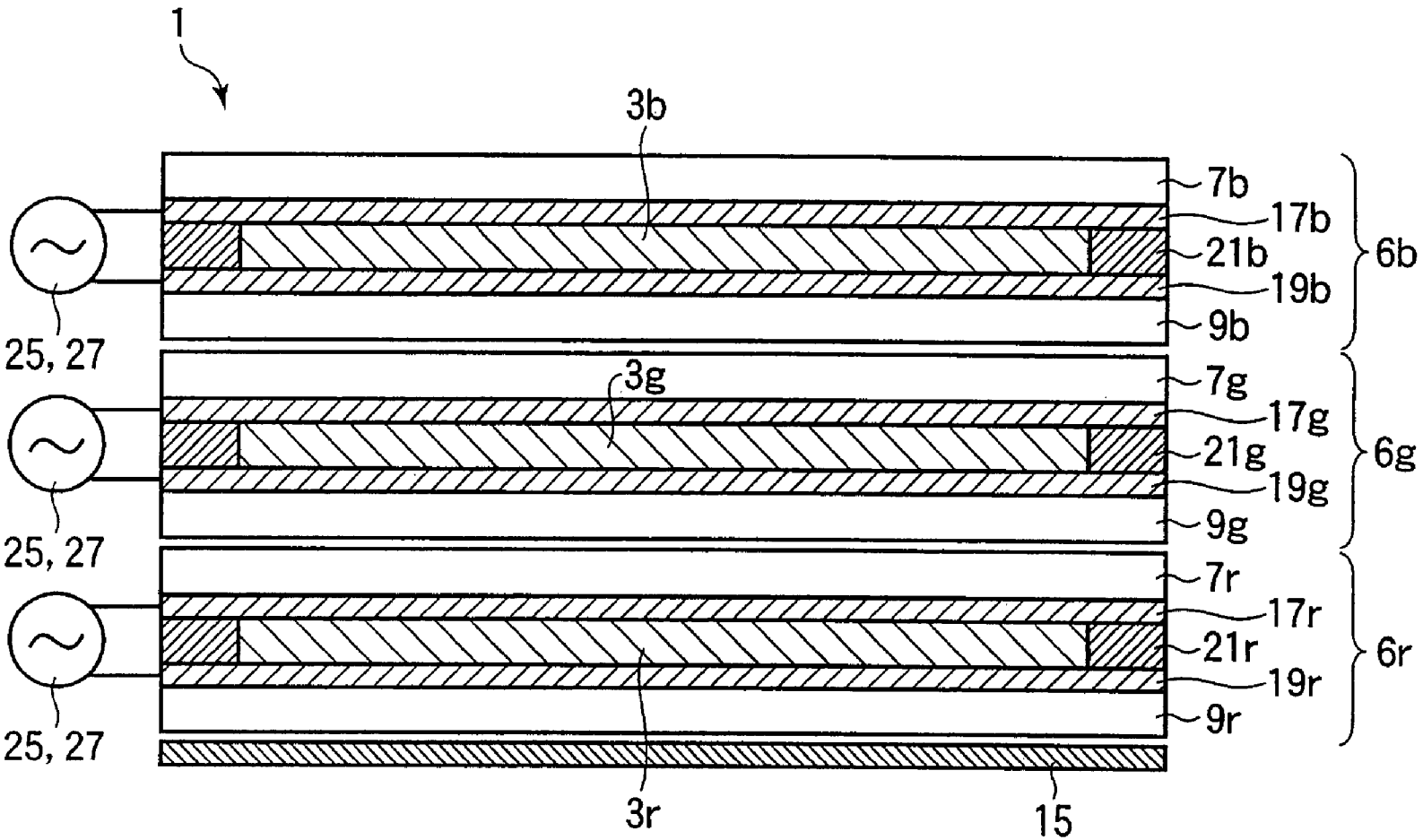
FIG. 2 schematically shows a sectional configuration of the liquid crystal display element 1 according to the embodiment of the invention.

A description will now be made with reference to FIGS. 1 to 19 on a liquid crystal display element, a driving method of the element, and an electronic paper having the element according an embodiment of the invention. The present embodiment will be described by referring to a liquid crystal display element 1 using cholesteric liquid crystals for blue (B), green (G), and red (R) by way of example. FIG. 1 shows a schematic configuration of the liquid crystal display element 1 of the present embodiment. FIG. 2 schematically shows a sectional configuration of the liquid crystal display element 1 taken along an imaginary straight line extending in the horizontal direction of FIG. 1.

As shown in FIGS. 1 and 2, the liquid crystal display element 1 includes a B display section (first display section) 6*b* for selectively reflecting blue (B) light as a selected wavelength band in a planar state, a G display section (second display section) 6*g* for selectively reflecting green (G) light as a selected wavelength band in a planar state, and an R display section (third display section) 6*r* for selectively reflecting red (R) light as a selected wavelength band in a planar state. The B, G, and R display sections 6*b*, 6*g*, and 6*r* are stacked in the order listed from a light entrance surface (display surface) of the element.

The B display section 6*b* includes a pair of substrates, i.e., upper and lower substrates 7*b* and 9*b* disposed opposite to each other and a B liquid crystal layer 3*b* enclosed between the substrates 7*b* and 9*b*. The B liquid crystal layer 3*b* has an average reflective index n and a helical pitch p adjusted to provide right-handed optical rotatory power (right-handed chirality) for selectively reflecting blue light. The layer is constituted by a cholesteric liquid crystal which reflects right-handed circularly polarized light in blue while transmitting light in other colors in the planar state and which transmits substantially all kinds of light in the focal conic state.

The G display section 6*g* includes a pair of substrates, i.e., upper and lower substrates 7*g* and 9*g* disposed opposite to each other and a G liquid crystal layer 3*g* enclosed between the substrates 7*g* and 9*g*. The G liquid crystal layer 3*g* has an average reflective index n and a helical pitch p adjusted to provide left-handed optical rotatory power (left-handed chirality) for selectively reflecting green light. The layer is constituted by a cholesteric liquid crystal which reflects left-handed circularly polarized light in green while transmitting light in other colors in the planar state and which transmits substantially all kinds of light in the focal conic state.

The R display section 6*r* includes a pair of substrates, i.e., upper and lower substrates 7*r* and 9*r* disposed opposite to each other and an R liquid crystal layer 3*r* enclosed between the substrates 7*r* and 9*r*. The R liquid crystal layer 3*r* has an average reflective index n and a helical pitch p adjusted to provide right-handed optical rotatory power (right-handed chirality) for selectively reflecting red light. The layer is constituted by a cholesteric liquid crystal which reflects right circularly polarized light in red while transmitting light in other colors in the planar state and which transmits substantially all kinds of light in the focal conic state.

Important factors in obtaining the liquid crystal display element 1 according to the present embodiment include the structure of the liquid crystal display element 1 and the physical properties of the material from which the element is formed. The cholesteric liquid crystal constituting each of the B, G, and R liquid crystal layers 3*b*, 3*g*, and 3*r* is provided by adding a chiral material to a nematic liquid crystal mixture to achieve a chiral material content in the range from 10 to 40% by weight. A chiral material content is a value represented on an assumption that the total amount of nematic liquid crystal components and the chiral material is 100% by weight. Various types of nematic liquid crystals known in the related art may be used. In order to keep driving voltages for the liquid crystal layers 3*b*, 3*g*, and 3*r* relatively low, the crystals preferably have dielectric constant anisotropy $\Delta\in$ satisfying $15 \leqq \Delta\in \leqq 35$. In the case of dielectric constant anisotropy $\Delta\in$ greater than the range, the liquid crystal layers 3*b*, 3*g*, and 3*r* have small specific resistances, although the driving voltages themselves can be kept low. This is not preferable because the power consumption of the liquid crystal display element 1 will consequently increase especially at high temperatures. The refractive index anisotropy $\Delta n$ of the cholesteric liquid crystals preferably has a value satisfying $0.18 \leqq \Delta n \leqq 0.24$. In the case of refractive index anisotropy $\Delta n$ smaller than the range, the liquid crystal layers 3*b*, 3*g*, and 3*r* have too small refractive indexes in the planar state. In the case of refractive index anisotropy $\Delta n$ greater than the range, the liquid crystal layers 3*b*, 3*g*, and 3*r* have great scattering reflections in the focal conic state, and the layers have high viscosity which reduces the speed of response.

The chiral materials added in the cholesteric liquid crystals for blue and red are optical isomers which have optical rotatory power different from that of the chiral material added in the cholesteric liquid crystal for green. Therefore, the cholesteric liquid crystals for blue and red are identical to each other and different from the cholesteric liquid crystal for green in terms of optical rotatory power.

Figure 3:
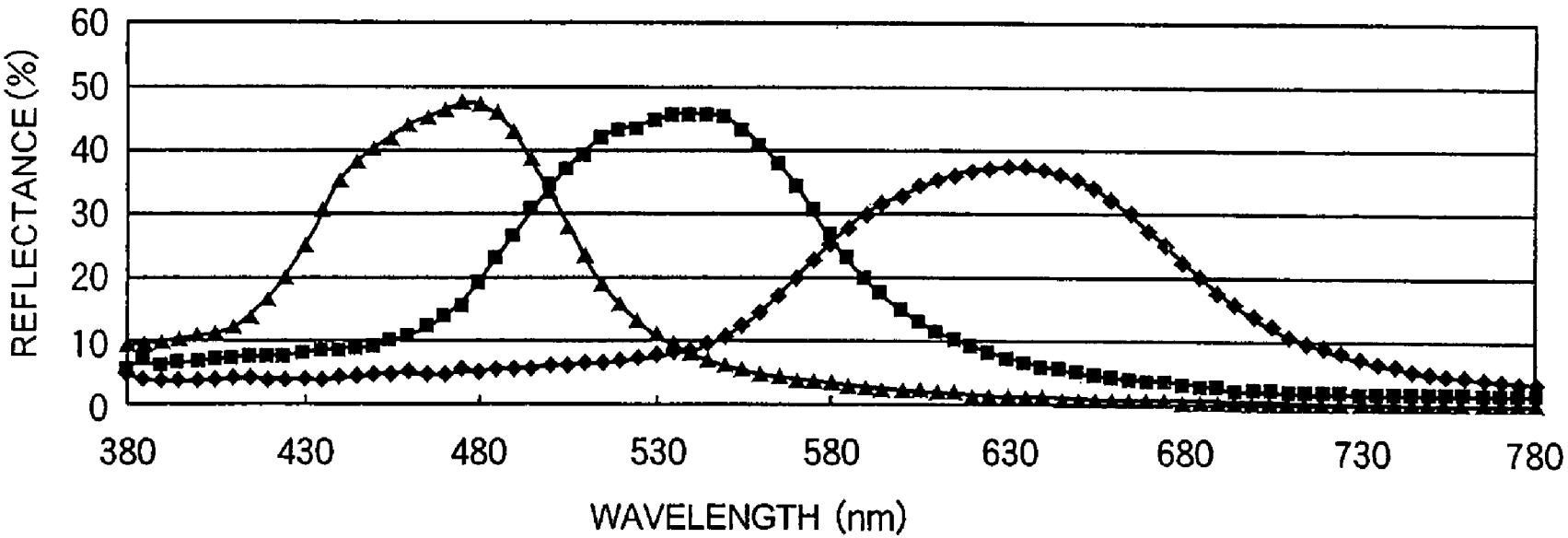
FIG. 3 shows examples of reflection spectra of the liquid crystal display element in a planar state.

FIG. 3 shows examples of reflection spectra of the liquid crystal layers 3*b*, 3*g*, and 3*r* in the planar state. The horizontal axis represents wavelengths (nm) of reflected light, and the vertical axis represents reflectance (in percentages to that of a white plate). The reflection spectrum of the B liquid crystal layer 3*b* is represented by the curve connecting the black triangular symbols in the figure. Similarly, the reflection spectrum of the G liquid crystal layer 3*g* is represented by the curve connecting the black square symbols in the figure, and the reflection spectrum of the R liquid crystal layer 3*r* is represented by the curve connecting the black rhombic symbols in the figure.

As shown in FIG. 3, the central wavelengths of the reflection spectra of the liquid crystal layers 3*b*, 3*g*, and 3*r* in the planar state have magnitudes in an ascending order that is the same as the order in which the layers are listed. In the multilayer structure formed by the B, G, and R display sections 6*b*, 6*g*, and 6*r*, the optical rotatory power of the G liquid crystal layer 3*g* is different from the optical rotatory power of the B and R liquid crystal layers 3*b* and 3*r* in the planar state. Therefore, in the regions where overlapping occurs between blue and green reflection spectra and between green and red reflection spectra shown in FIG. 3, right circularly polarized light can be reflected by the B liquid crystal layer 3*b* and the R liquid crystal layer 3*r*, and left circularly polarized light can be reflected by the G liquid crystal layer 3*g*. As a result, loss of reflected light can be reduced to improve the brightness of the display screen of the liquid crystal display element 1.

The upper substrates 7*b*, 7*g*, and 7*r* and the lower substrates 9*b*, 9*g*, and 9*r* must have translucency. In the present embodiment, pairs of film substrates cut in longitudinal and transverse dimensions of 10 (cm)×8 (cm) are used. The film substrates may be made of polyethylene terephthalate (PET), polycarbonate (PC) or the like. Film substrates made of such materials have sufficient flexibility. Glass substrates may be used instead of film substrates. While all of the upper substrates 7*b*, 7*g*, and 7*r* and the lower substrates 9*b*, 9*g*, and 9*r* have translucency in the present embodiment, the lower substrate 9*r* of the R display section 6*r* disposed at the bottom of the element may be opaque.

As shown in FIGS. 1 and 2, a plurality of data electrodes 19*b* in the form of strips are formed in parallel to extend in the vertical direction of FIG. 1, the electrodes being located on the side of the lower substrate 9*b* of the B display section 6*b* where the B liquid crystal layer 3*b* is provided. Reference numeral 19*b* in FIG. 2 represents the region where the plurality of data electrodes 19*b* is provided. A plurality of scan electrodes 17*b* in the form of strips are formed in parallel to extend in the horizontal direction of FIG. 1, the electrodes being located on the side of the upper substrate 7*b* where the B liquid crystal layer 3*b* is provided. As shown in FIG. 1, the plurality of scan electrodes 17*b* and data electrodes 19*b* are disposed opposite to each other to intersect with each other when the upper and lower substrates 7*b* and 9*b* are viewed in the normal direction of the surfaces on which the electrodes are formed. In the present embodiment, 480 scan electrodes 17*b* and 640 data electrodes 19*b* in the form of stripes having a pitch of 0.12 mm are formed by patterning a transparent electrode to achieve VGA display with 480×640 dots. Each of intersections between the electrodes 17*b* and 19*b* sandwiching the B liquid crystal layer 3*b* constitutes a B pixel 12*b*. The plurality of B pixels 12*b* is disposed in the form of a matrix having 480 rows and 640 columns.

Similarly to the B display section 6*b*, the G display section 6*g* is formed with 480 scan electrodes 17*g*, 640 data electrodes 19*g*, and G pixels 12*g* (not shown) arranged in the form of a matrix having 480 rows and 640 columns. Similarly, scan electrodes 17*r*, data electrodes 19*r*, and R pixels 12*r* (not shown) are formed at the R display section 6*r*. One set of B, G, and R pixels 12*b*, 12*g*, and 12*r* constitutes one pixel 12 of the liquid crystal display element 1. The pixels 12 are arranged in the form of a matrix to form a display screen.

Referring to the material to form the scan electrodes 17*b*, 17*g*, and 17*r* and the data electrodes 19*b*, 19*g*, and 19*r*, for example, an indium tin oxide (ITO) is typically used. However, transparent conductive films made of an indium zinc oxide (IZO) or the like may alternatively be used.

A scan electrode driving circuit 25 carrying scan electrode driver ICs for driving the plurality of scan electrodes 17*b*, 17*g*, and 17*r* is connected to the upper substrates 7*b*, 7*g*, and 7*r*. A data electrode driving circuit 27 carrying data electrode driver ICs for driving the plurality of data electrodes 19*b*, 19*g*, and 19*r* is connected to the lower substrates 9*b*, 9*g*, and 9*r*. A driving section 24 including the scan electrode driving circuit 25 and the data electrode driving circuit 27 is provided.

The scan electrode driving circuit 25 selects three predetermined scan electrodes 17*b*, 17*g*, and 17*r* based on a predetermined signal output by a control circuit section 23 and simultaneously outputs scan signals to the three scan electrodes 17*b*, 17*g*, and 17*r*. The data electrode driving circuit 27 outputs image data signals for the B, G, and R pixels 12*b*, 12*g*, and 12*r* on the selected scan electrodes 17*b*, 17*g*, and 17*r* to the respective data electrodes 19*b*, 19*g*, and 19*r* based on a predetermined signal output by the control circuit section 23. For example, general-purpose STN driver ICs having a TCP (tape carrier package) structure are used as the driver ICs for the scan electrodes and the data electrodes. A driving unit including the control circuit section 23 and the driving section 24 is provided. The driving unit displays a multiplicity of grayscales by executing a first step for initializing a liquid crystal in a pixel and displaying an initial grayscale at the pixel and a second step for displaying a desired grayscale lower than the initial grayscale by making a cumulative time difference between low grayscales lower than a reference grayscale longer than a cumulative time difference between high grayscales higher than the reference grayscale, where a cumulative time difference is a difference between a cumulative voltage application time of voltage pulses cumulatively applied to display a grayscale lower than the initial grayscale and a cumulative voltage application time of voltage pulses cumulatively applied to display a grayscale one level lower than the grayscale below the initial grayscale. The detailed configuration of the driving unit including the control circuit section 23 will be described with reference to FIG. 14.

In the present embodiment, since driving voltages for the B, G and R liquid crystal layers 3*b*, 3*g*, and 3*r* can be made substantially equal to each other, a predetermined output terminal of the scan electrode driving circuit 25 is commonly connected to predetermined input terminals of the scan electrodes 17*b*, 17*g*, and 17*r*. As a result, there is no need for providing a scan electrode driving circuit 25 for each of the B, G, and R display sections 6*b*, 6*g*, and 6*r*, and the driving circuits of the liquid crystal display element 1 can be simplified in configuration. Further, since the number of scan electrode driver ICs can be reduced, the liquid crystal display element 1 can be provided at a low cost. The output terminal of the scan electrode driving circuit 25 for B, G, and R may be commonly used as occasion demands.

Each of the electrodes 17*b* and 19*b* is preferably coated with functional films, i.e., an insulation film and an alignment film for controlling the alignment of liquid crystal molecules (both of the films are not shown). The insulation film has the function of preventing a shorting between the electrodes 17*b* and 19*b* and serves as a gas barrier layer to improve the reliability of the liquid crystal display element 1. A polyimide resin or acryl resin may be used for the alignment film. For example, the substrates are entirely coated with alignment films covering the electrodes 17*b* and 19*b*. The alignment films may also serve as insulation thin films. When the thickness of the insulating thin films is too great, the driving voltages of the liquid crystals become too high to be properly controlled by general-purpose STN drivers. On the contrary, when no insulating thin film is provided, the liquid crystal display element 1 has higher power consumption because a leak current can flow. Since the insulating thin films have a dielectric constant of about 5 which is considerably smaller than that of a liquid crystal, a preferable thickness of the films is about 0.3 μm or less. For example, the insulating thin films may be $SiO_2$ thin films or organic films made of a polyimide resin or acryl resin which are known as alignment stabilizing films.

As shown in FIG. 2, the B liquid crystal layer 3*b* is enclosed between the substrates 7*b* and 9*b* by a sealing material 21*b* applied to the peripheries of the upper and lower substrates 7*b* and 9*b*. The B liquid crystal layer 3*b* must have a uniform thickness (cell gap) d. In order to maintain a predetermined call gap d, spherical spacers made of a resin or inorganic oxide are dispersed in the B liquid crystal layer 3*b*. Alternatively, a plurality of columnar spacers is formed in the B liquid crystal layer 3*b*. In the liquid crystal display element 1 of the present embodiment, spacers (not shown) are inserted in the B liquid crystal layer 3*b* to keep the cell gap d uniform. More preferably, wall structures having adhesive properties are formed around pixels. The cell gap d of the B liquid crystal layer 3*b* is preferably in a range expressed by 3.5 μm≦d≦6 μm. When the cell gap d is smaller than the range, the liquid crystal layer 3*b* will have a low reflectance in the planar state. When the cell gap d exceeds the range, driving voltages become too high.

The G display section 6*g* and the R display section 6*r* will not be described because they have a structure similar to that of the B display section 6*b*. A visible light absorbing layer 15 is provided on an outer surface (back side) of the lower substrate 9*r* of the R display section 6*r*. The visible light absorbing layer 15 thus provided allows efficient absorption of light which has not been reflected by the B, G, and R liquid crystal layers 3*b*, 3*g*, and 3*r*. Therefore, the liquid crystal display element 1 is capable of display with a high contrast ratio. The visible light absorbing layer 15 may be provided as occasion demands.

A method for multi-grayscale display implemented in the liquid crystal display element 1 of the present embodiment will now be described with reference to FIGS. 4 to 19. In the present embodiment, multi-grayscale display is performed by applying a voltage pulse to a liquid crystal in a pixel in a cumulative manner to provide a low grayscale utilizing cumulative response characteristics of a cholesteric liquid crystal. Each time a pulse voltage having a predetermined voltage value is applied to a cholesteric liquid crystal, the ratio of focal conic domains is increased to cause a gradual transition from the planar state to the focal conic state utilizing the cumulative response characteristics. Alternatively, such cumulative response characteristics of a cholesteric liquid crystal may be used to cause a gradual transition from the focal conic state to the planar state.

Figure 4:
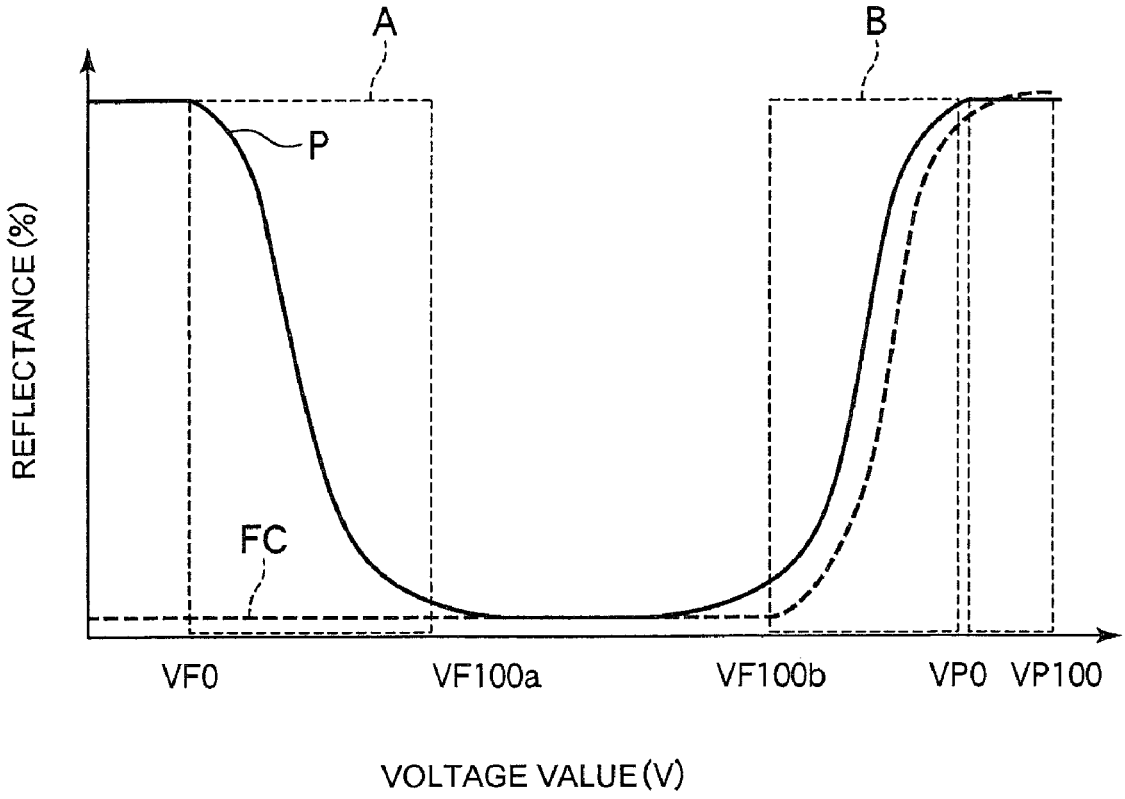
FIG. 4 shows an example of voltage-reflectance characteristics of a cholesteric liquid crystal.

FIG. 4 shows an example of voltage-reflectance characteristics of a common cholesteric liquid crystal. The horizontal axis represents voltage values (V) of a pulse voltage having a predetermined pulse width (e.g., 4.0 ms) applied between two electrodes 17 and 19 sandwiching the cholesteric liquid crystal, and the vertical axis represents reflectance (%) of the cholesteric liquid crystal. The curve P in a solid line shown in FIG. 4 represents voltage-reflectance characteristics observed when the initial state of the cholesteric liquid crystal is the planar state, and the curve FC in a broken line represents voltage-reflectance characteristics observed when the initial state of the cholesteric liquid crystal is the focal conic state.

Referring to FIG. 4, when a predetermined high voltage VP100 (e.g., ±36 V) is applied between the electrodes 17 and 19 to generate an electric field having a relatively high intensity in the cholesteric liquid crystal, helical structures of liquid crystal molecules are completely decomposed, and the liquid crystal enters a homeotropic state in which all liquid crystal molecules are aligned according to the direction of the electric field. Let us assume that the applied voltage is abruptly decreased from the voltage VP100 to a predetermined low voltage (e.g., a voltage VF0 of ±4 V) to make the electric field in the liquid crystal substantially zero abruptly when the liquid crystal molecules are in the homeotropic state. Then, the liquid crystal molecules enters a helical state in which their helical axes are in a direction substantially perpendicular to the electrodes 17 and 19 or a planar state in which they selectively reflect beams of light having a wavelength in accordance with the helical pitch.

When a predetermined low voltage VF100*b* (e.g., ±24 V) is applied between the electrodes 17 and 19 to generate an electric field having a relatively low intensity in the cholesteric liquid crystal, the helical structures of liquid crystal molecules are not completely decomposed. When the applied voltage is abruptly decreased from the voltage VF100*b* to the low voltage VF0 in this state to make the electric field in the liquid crystal substantially zero, the liquid crystal molecules enter a helical state in which their helical axes are in a direction substantially parallel to the electrodes 17 and 19 or a focal conic state in which they transmit incident beams of light. The cholesteric liquid crystal can be also put in the focal conic state by applying the high voltage VP100 to generate an electric field having a high intensity in the liquid crystal layer and slowly removing the electric field thereafter.

Referring to the curve P shown in FIG. 4, the reflectance of the cholesteric liquid crystal can be reduced as the voltage value (V) of the pulse voltage applied between the electrodes 17 and 19 is increased within the window A drawn in a broken line. Referring to the curve P and the curve FC shown in FIG. 4, the reflectance of the cholesteric liquid crystal can be reduced as the voltage value (V) of the pulse voltage applied between the electrodes 17 and 19 is decreased within the window B drawn in a broken line.

Figure 5:
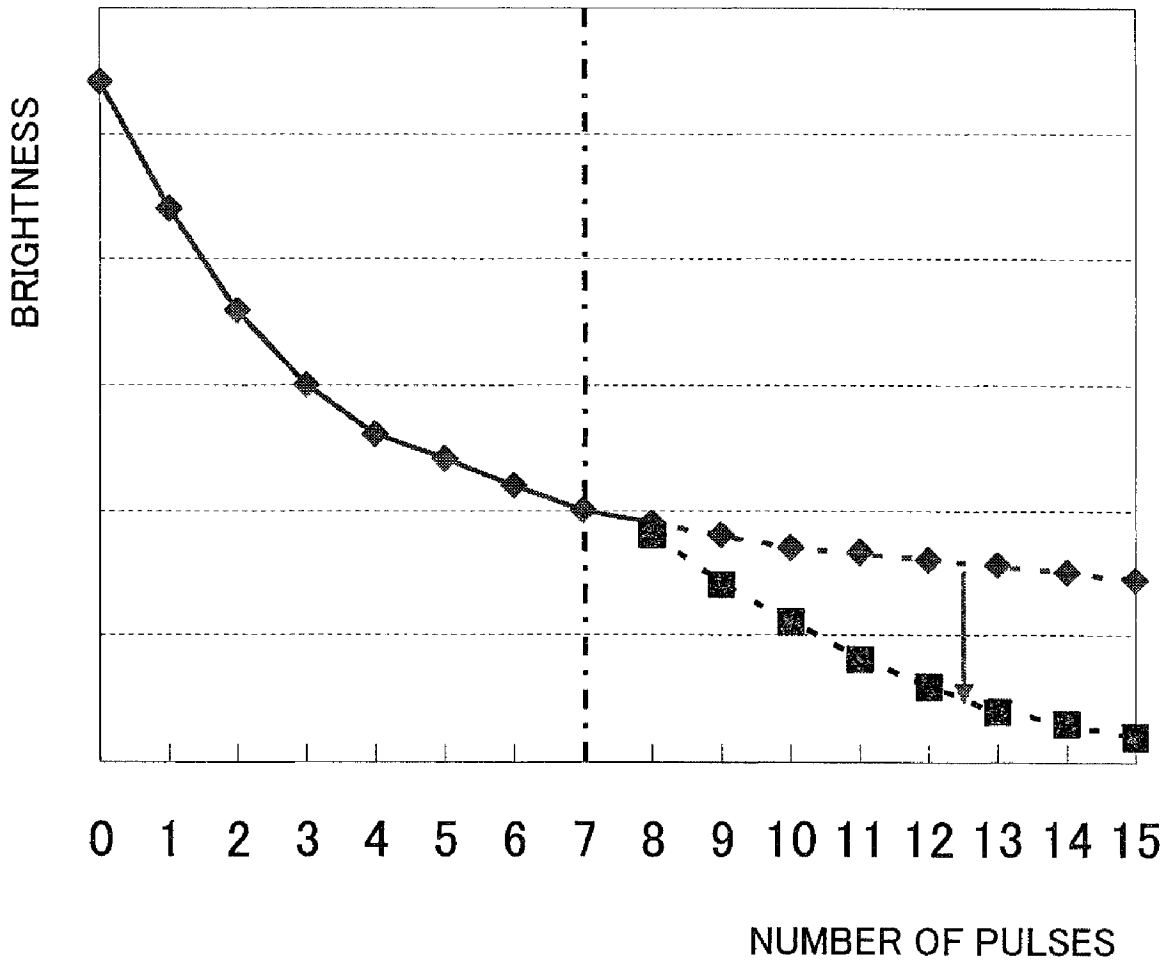
FIG. 5 is a graph showing the brightness of a display screen observed when voltage pulses are cumulatively applied to cholesteric liquid crystals used in the liquid crystal display element 1 according to the embodiment of the invention.
Figure 6:
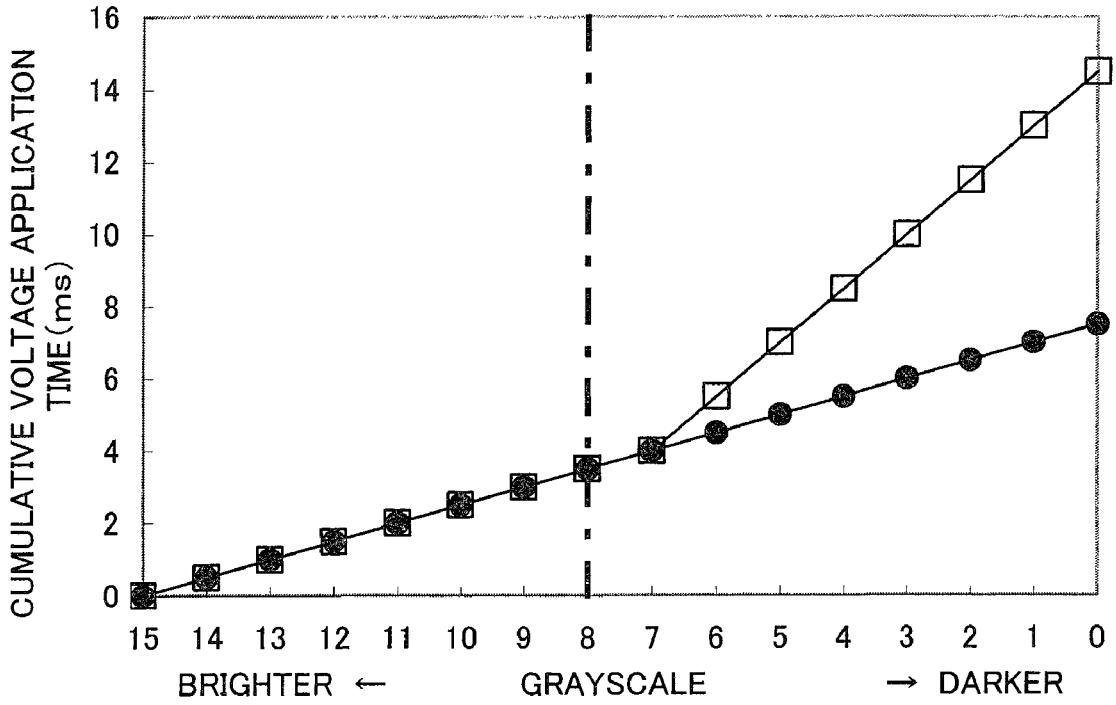
FIG. 6 is a graph showing a relationship between grayscales displayed at a pixel and cumulative voltage application times of the voltage pulses cumulatively applied to the cholesteric liquid crystals in the embodiment of the invention.

The fundamental principle of the method of driving a liquid crystal display element according to the present embodiment will now be described with reference to FIGS. 5 and 6. FIG. 5 is a graph showing the brightness of the display screen observed when voltage pulses are cumulatively applied to cholesteric liquid crystals. The horizontal axis represents counts of voltage pulses applied, and the vertical axis represents brightness. The characteristics of the liquid crystal display element of present embodiment are represented by the curve connecting the black rhombic symbols in the figure obtained at pulse counts from 0 to 7 and the curve connecting the black square symbols in the figure obtained at pulse counts from 8 to 15. The characteristics of a liquid crystal display element according to the related art are represented by the curve connecting the black rhombic symbols in the figure. The chain line shown in the figure represents a reference grayscale. FIG. 6 is a graph showing a relationship between grayscales displayed at a pixel and cumulative voltage application times of the voltage pulses cumulatively applied to the cholesteric liquid crystals. The horizontal axis represents grayscales, and the vertical axis represents cumulative voltage application times (ms). The characteristics of the liquid crystal display element 1 of the present embodiment are represented by the curve connecting the white squares in the figure, and the characteristics of the liquid crystal display element according to the related art are represented by the straight line connecting the black circles. The chain line shown in the figure represents the reference grayscale.

Voltage pulses for writing predetermined grayscales in a pixel of the liquid crystal display element according to the related art have a fixed pulse width. A cholesteric liquid crystal exhibits high response when a voltage pulse is first applied after the liquid crystal is reset to the planar state in which it has the highest brightness, but the response gradually becomes slow. As shown in FIG. 5, the liquid crystal display element according to the related art exhibits high pulse response, for example, when the number of voltage pulses which have been applied is six or seven. However, pulse response abruptly becomes slow beyond the pulse count. Therefore, although the liquid crystal display element according to the related art can display about eight grayscales after displaying fifteen grayscales in the planar state, it has difficulty in displaying grayscales 7 to 0.

The inventors have found that the reduction in the pulse response of a liquid crystal can be compensated by making the pulse width of voltage pulses applied to the liquid crystal to display lower grayscales longer than that of voltage pulses for higher grayscales. For example, let us assume that voltage pulses applied to the liquid crystal corresponding to pulse counts 0 to 7 associated with grayscales 15 to 8 have a pulse width of 1 and that voltage pulses corresponding to pulse counts 8 to 15 associated with grayscales 7 to 0 have a pulse width of 3. More specifically, let us assume that a cumulative time difference is a difference between a cumulative voltage application time of voltage pulses cumulatively applied to display a predetermined grayscale and a cumulative voltage application time of voltage pulses cumulatively applied to display a grayscale one level lower than the predetermined grayscale. In the present embodiment, cumulative time differences between low grayscales lower than a reference grayscale (grayscale levels "0" to "7") are made longer than cumulative time differences between high grayscales equal to or higher than the reference grayscale (grayscale levels "8" to "15").

Then, as shown in FIG. 6, the liquid crystal display element 1 of the present embodiment has longer cumulative voltage application times for low grayscales (grayscale levels "0" to "7") lower than the reference grayscale when compared to the cumulative voltage application times of the liquid crystal display element according to the related art. Since compensation is provided for the response of the cholesteric liquid crystal to voltage pulses as thus described, the brightness of the display screen of the liquid crystal display element 1 of the present embodiment can be properly reduced compared to that of the liquid crystal display element according to the related art when the same number of pulses are applied. Therefore, the liquid crystal display element 1 can properly display all grayscales.

Figures 7A, 7B, 7C:
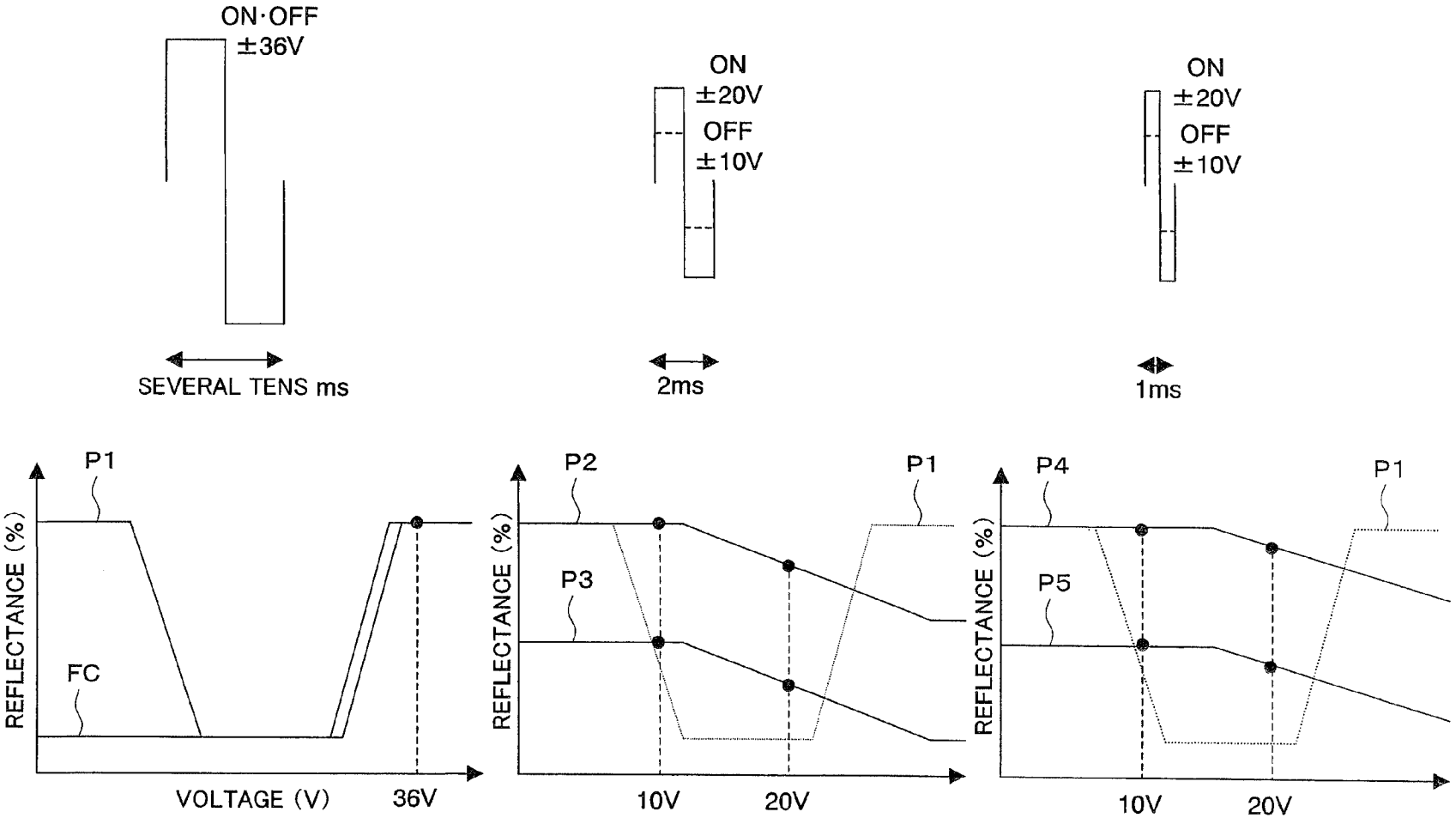
FIGS. 7A to 7C show examples of voltage pulse response characteristics of a cholesteric liquid crystal used in the liquid crystal display element 1 according to the embodiment of the invention.

A description will now be made on the fundamental principle of a driving method used in the present embodiment to achieve multi-grayscale display. FIGS. 7A to 7C show examples of voltage pulse response characteristics of a cholesteric liquid crystal. FIG. 7A shows pulse response characteristics observed when voltage pulses have a pulse width of several tens ms. FIG. 7B shows pulse response characteristics observed when voltage pulses have a pulse width of 2 ms. FIG. 7C shows pulse response characteristics observed when voltage pulses have a pulse width of 1 ms. Voltage pulses applied to the cholesteric liquid crystal are shown in the upper parts of FIGS. 7A to 7C. Voltage-reflectance characteristics of the cholesteric liquid crystal are shown in the lower parts of the figures in which the horizontal axes represent voltages (V) and the vertical axes represent reflectance (%).

The voltage-reflectance characteristics shown in FIG. 7A are voltage-reflectance characteristics of a cholesteric liquid crystal similar to those shown in FIG. 4. The curve P1 shown in FIG. 7A represents voltage-reflectance characteristics of the cholesteric liquid crystal observed when the initial state is the planar state. The curve FC represents voltage-reflectance characteristics of the cholesteric liquid crystal observed when the initial state is the focal conic state. As shown in FIG. 7A, in the case where the initial state is the planar state, when the value of a voltage pulse is increased into a certain range, the voltage enters a driving band to obtain the focal conic state. When the voltage value of the voltage pulse is further increased to, for example, 36 V, the voltage enters the driving band for the planar state again (see the curve P1).

When the initial state is the focal conic state, the voltage pulse gradually approaches the driving band to obtain the planar state as the voltage value is increased (see the curve FC). In FIG. 7A, the voltage value at which the driving band for the planar state is entered is ±36 V regardless of whether the initial state is the planar state or the focal conic state. A driving waveform for a cholesteric liquid crystal must be an alternate current as shown in the upper parts of FIGS. 7A to 7C in order to suppress deterioration of the liquid crystal just as done in common liquid crystals when it is driven in a dot matrix manner. When a voltage located intermediate between the bands is applied, an intermediate grayscale that is a mixture of the planar state and the focal conic state as described above is obtained.

As shown in FIG. 7B, when a voltage pulse having a voltage lower or a pulse width (pulse period) smaller than voltage pulse with ±36 V is applied to the cholesteric liquid crystal, the response of the same is shifted to the right regardless of whether the initial state is the planar state (curve P2) or an intermediate grayscale state (curve P3). FIG. 7B shows the same curve P1 as shown in FIG. 7A (which has a pulse width of several tens ms) in a broken line for the purpose of comparison. For example, when the voltage pulse has a voltage value of ±10 V and a pulse width of 2 ms, the planar state or intermediate grayscale state is maintained, and no change occurs in the reflectance of the liquid crystal. On the contrary, when the voltage pulse has a voltage value of ±20 V and a pulse width of 2 ms, the reflectance of the cholesteric liquid crystal decreases a predetermined amount.

As shown in FIG. 7C, when a voltage pulse having a voltage lower than ±20 V or a smaller pulse width (pulse period) is applied to the cholesteric liquid crystal, the response of the same is shifted further to the right regardless of whether the initial state is the planar state (curve P4) or the intermediate grayscale state (curve P5). FIG. 7C shows the same curve P1 as shown in FIG. 7A (which has a pulse width of several tens ms) in a broken line for the purpose of comparison. For example, when the voltage pulse has a voltage value of ±10 V and a pulse width of 1 ms, the planar state or intermediate grayscale state is maintained, and no change occurs in the reflectance of the liquid crystal. On the contrary, when the voltage pulse has a voltage value of ±20 V and a pulse width of 1 ms, the reflectance of the cholesteric liquid crystal decreases a predetermined amount. The amount of the reduction in reflectance resulting from the pulse width of 1 ms is smaller than the amount of the reduction in reflectance resulting from the pulse width of 2 ms. Therefore, when grayscales provided by voltage pulses having the same voltage value and different pulse widths are compared, the voltage pulse having the longer pulse width allows a lower grayscale to be displayed compared to the other. The present embodiment takes advantage of such a characteristic to provide compensation for any reduction in pulse response of a liquid crystal at low grayscales.

The method of driving the liquid crystal display element 1 will now be specifically described with reference to FIGS. 8A to 13. The method of driving a liquid crystal display element according to the present embodiment is characterized in that it includes a first step for initializing a liquid crystal in a pixel and displaying an initial grayscale at the pixel and a second step for displaying a desired grayscale lower than the initial grayscale by making a cumulative time difference between low grayscales lower than a reference grayscale longer than a cumulative time difference between high grayscales higher than the reference grayscale, where a cumulative time difference is a difference between a cumulative voltage application time of voltage pulses cumulatively applied to display a grayscale lower than the initial grayscale and a cumulative voltage application time of voltage pulses cumulatively applied to display a grayscale one level lower than the grayscale below the initial grayscale.

FIGS. 8A to 8D schematically show a display screen obtained at a first step S1 of the method of driving the liquid crystal display element 1. FIG. 9 shows values of voltages output by the scan electrode driving circuit 25 and the data electrode driving circuit 27 and voltage values of voltage pulses applied to the B, G, and R liquid crystal layers 3*b*, 3*g*, and 3*r* provided at the B, G, and R display sections 6*b*, 6*g*, and 6*r*, respectively, at the first step.

Figure 8A:
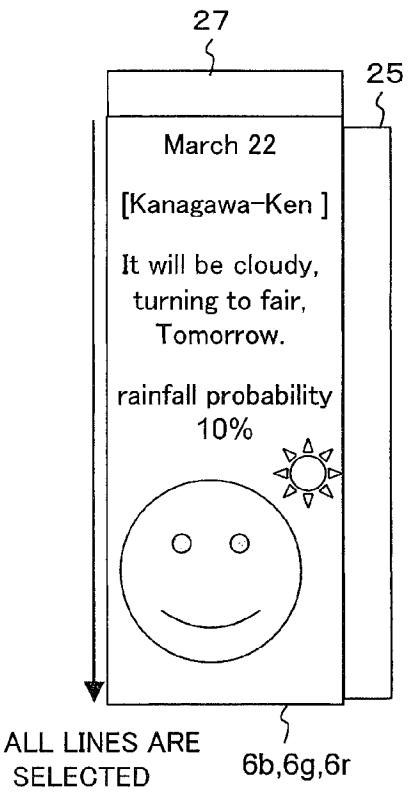
FIGS. 8A to 8D schematically show a display screen obtained at a first step S1 of the method of driving the liquid crystal display element 1 according to the embodiment of the invention.

As shown in FIG. 8A, text characters and graphics are displayed on the B, G, and R display sections 6*b*, 6*g*, and 6*r*. As shown in FIG. 9, in a first half of a selection period, the output voltage from the data electrode driving circuit 27 has a voltage value of +36 V, whereas the output voltage from the scan electrode driving circuit 25 has a voltage value of 0 V. As a result, a voltage of +36 V is applied to the B, G, and R liquid crystal layers 3*b*, 3*g*, and 3*r* to put the B, G, and R liquid crystal layers 3*b*, 3*g*, and 3*r* in the homeotropic state.

Figure 8B:
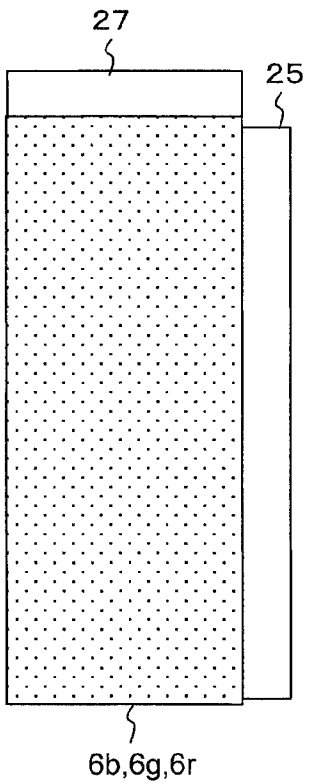

In the present embodiment, all pixels in the B, G, and R display sections 6*b*, 6*g*, and 6*r* are selected, and all liquid crystals in the pixels are entirely selected and initialized. All pixels may be selected to initialize the liquid crystals thereof entirely by applying a reference voltage to the liquid crystals or shorting at least either data electrodes or scan electrodes to a reference potential. Specifically, all output lines of the scan electrode driving circuit 25 may be selected with all of the voltages output by both of the electrode driving circuits 25 and 27 set at a reference potential (ground) level. In order to set all voltages output by both of the electrode driving circuits 25 and 27 at the ground level, a voltage turn-off function (/DSPOF) of the general-purpose STN drivers provided at each of the electrode driving circuits 25 and 27 may be asserted. When the voltage turn-off function of the data electrode driving circuit 27 is thereafter negated, a voltage of +36 V is applied to all scan electrodes thus selected. As a result, the liquid crystals at all pixels are put in the homeotropic state as shown in FIG. 8B.

Figure 8C:
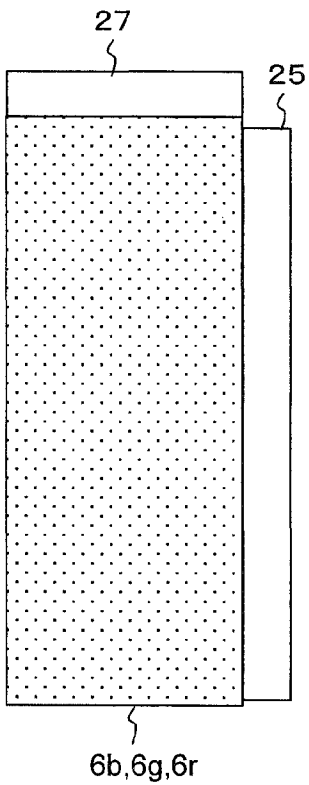

As shown in FIG. 9, in a second half of the selection period, the output voltage from the data electrode driving circuit 27 has a voltage value of 0 V, whereas the output voltage from the scan electrode driving circuit 25 has a voltage value of +36 V. Thus, a voltage of −36 V is applied to the B, G, and R liquid crystal layers 3*b*, 3*g*, and 3*r*. As a result, the B, G, and R liquid crystal layers 3*b*, 3*g*, and 3*r* are kept in the homeotropic state as shown in FIG. 8C. For example, a polarity inversion signal (FR) for the general-purpose STN drivers may be inverted to invert the voltage applied to the B, G, and R liquid crystal layers 3*b*, 3*g*, and 3*r* from +36 V to −36 V.

At the reset process of the first step S1, the output voltages from the electrode driving circuits 25 and 27 may be set at various voltage values. The voltages are preferably set as shown in FIG. 9 because the setting allows a voltage of ±36 V to be applied to the liquid crystals at all pixels regardless of the value of the voltage output by the data electrode driving circuit 27.

Figure 8D:
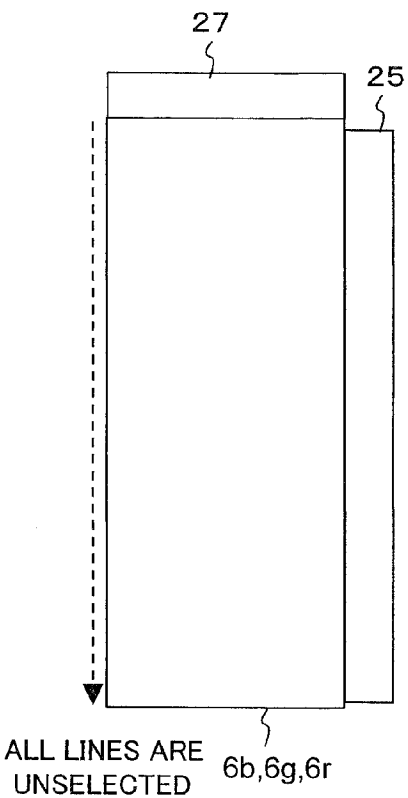

As shown in FIG. 9, in a first half of a non-selection period that follows the end of the selection period, the output voltages from the electrode driving circuits 25 and 27 have a voltage value of 0 V. Further, the output voltages from the electrode driving circuits 25 and 27 have a voltage value of 0 V in a second half of the non-selection period. Since a voltage of 0 V is consequently applied to the B, G, and R liquid crystal layers 3*b*, 3*g*, and 3*r* in the non-selection period, the liquid crystals at all pixels change from the homeotropic state to the planar state as shown in FIG. 8D. In the present embodiment, since the B, G, and R liquid crystal layers 3*b*, 3*g*, and 3*r* are initialized into the planar state at the first step S1, the liquid crystal display element 1 displays the highest grayscale (grayscale 15) at all pixels as the initial grayscale.

The change from −36 V in the selection period to 0 V in the non-selection period is preferably caused using the voltage turn-off function (/DSPOF) of the general-purpose driver ICs described above. When the voltage turn-off function is used, the electric charges held in the B, G, and R liquid crystal layers 3*b*, 3*g*, and 3*r* are forcibly discharged by shorting circuits of the general-purpose STN drivers. Therefore, the discharging time of the electrical charges charged in the B, G, and R liquid crystal layers 3*b*, 3*g*, and 3*r* is very short. A transition to the planar state requires steepness of voltage pulses. The method of forcibly discharging the electric charges using the voltage turn-off function is preferable also in this regard in that even a display element having a great screen size can be reliably reset to the planar state.

Figure 10:
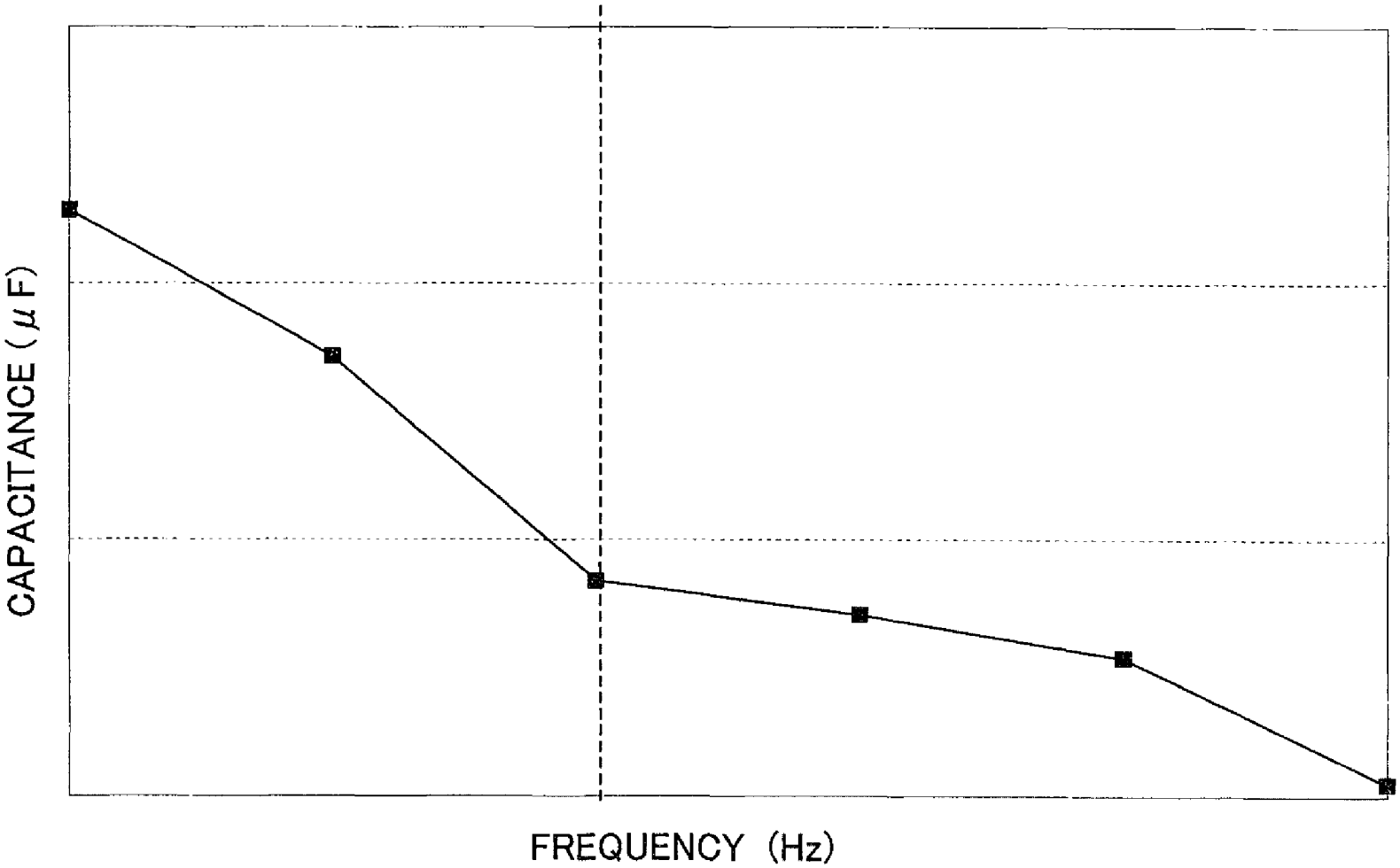
FIG. 10 is a graph showing a relationship between the frequency of a voltage pulse applied to a cholesteric liquid crystal used in the liquid crystal display element 1 according to the embodiment of the invention and the capacitance of the cholesteric liquid crystal.

The pulse width of the voltage pulse applied at the first step S1 will now be described with reference to FIG. 10. FIG. 10 is a graph showing a relationship between the frequency of a voltage pulse applied to the cholesteric liquid crystals and the capacitance of the liquid crystal display element having the cholesteric liquid crystal. The horizontal axis represents the frequency (Hz) of the voltage pulse, and the vertical axis represents the capacitance value (μm) of the liquid crystal display element.

A cholesteric liquid crystal has higher ionicity compared to nematic liquid crystals used in common liquid crystal display elements. It has been revealed that when voltage pulses applied to a cholesteric liquid crystal have low frequencies, an abrupt increase in the capacitance of a liquid crystal display element having the liquid crystal can be caused by polarization of ionic components at a certain frequency, as shown in FIG. 10. In FIG. 10, the broken line indicates a frequency boundary where such an abrupt increase in the capacitance of a liquid crystal display element occurs. A liquid crystal display element having a great capacitance has a great time constant, and a transition to the homeotropic state is therefore unlikely to occur in the element. For this reason, in the present embodiment, the frequency of voltage pulses applied to the liquid crystals at the first step S1 is set higher than a frequency at which polarization of the liquid crystals attributable to ionic substances becomes significant. Specifically, the frequency of the voltage pulses used at the first step S1 is set at a value higher than a boundary at which the capacitance of the liquid crystal display element 1 increases. A proper value for the frequency of the voltage pulses used at the first step depends on the configuration of the liquid crystal display element. In the present embodiment, an adequate frequency or pulse width of the voltage pulses is several ms to several tens ms.

A description will now be made on display of grayscales performed at a second step S2 of the method of driving the liquid crystal display element 1. The second step S2 of the present embodiment includes a plurality of sub-steps for applying voltage pulses having equal voltage values and different pulse widths to the B, G, and R liquid crystal layers 3*b*, 3*g*, and 3. In the present embodiment, voltage pulses are cumulatively applied to the B, G, and R liquid crystal layers 3*b*, 3*g*, and 3*r* at each sub-step as occasion demands to achieve a reduction from an initial grayscale or a grayscale of level "15" to a desired grayscale. The method will be described below using an example in which a predetermined voltage is applied to a blue (B) pixel 12*b* (1,1) at an intersection between a data electrode 19*b* constituting the first column of the B display section 6*b* shown in FIG. 1 and a scan electrode 17*b* constituting the first row of the same.

Figure 11:
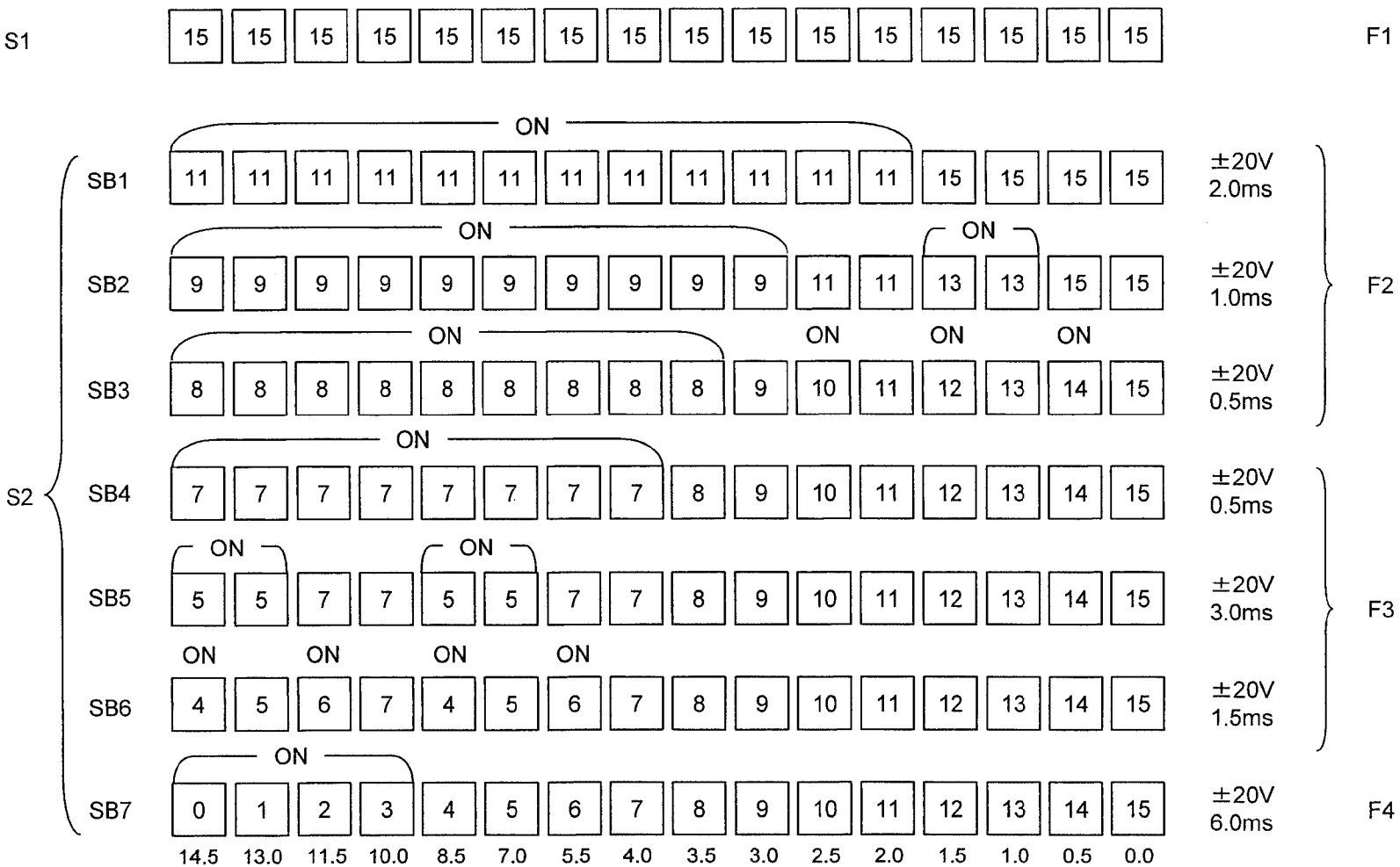
FIG. 11 is an illustration for explaining display of grayscales at the second step S2 of the method of driving the liquid crystal display element 1 according to the invention.

FIG. 11 is an illustration for explaining display of grayscales at the second step of the method of driving the liquid crystal display element 1. The first line of the illustration in FIG. 11 shows a grayscale displayed at the B pixel 12*b* (1,1) at the end of the first step S1. The second to seventh lines show grayscales displayed at the B pixel 12*b* (1,1) at interim stages of the second step S2. The eighth line shows grayscales displayed at the B pixel 12*b* (1,1) at the end of the second step S2. In the present embodiment, the second step S2 includes seven sub-steps, i.e., first to seventh sub-steps SB1 to SB7.

The plurality of squares shown in FIG. 11 schematically represent the outline of one pixel, and numerals shown in the squares represent grayscale levels. The liquid crystal display element 1 of the present embodiment is capable of displaying 16 grayscales in total, i.e., levels "0" to "15". Voltage values and application times of voltage pulses applied to the B, G, and R liquid crystal layers 3*b*, 3*g*, and 3*r* at the sub-steps SB1 to SB7 are shown on the right side of the figure. Cumulative voltage application times required for displaying the grayscales at levels "0" to "15" are shown at the bottom of the figure. The cumulative voltage application times are in milliseconds. The voltage values and application times shown on the right side represent voltage pulses applied to the liquid crystals in selection periods at each of the sub-steps SB1 to SB7.

In the present embodiment, driving is carried out at the second step S2 by dividing the first to seventh sub-steps SB1 to SB7 into three frames as shown in FIG. 11. The first to third sub-steps SB1 to SB3 collectively constitute one frame (frame F2). The fourth to sixth sub-steps SB4 to SB6 collectively constitute one frame (frame F3). The seventh sub-step SB7 constitutes one frame (frame F4) alone. As thus described, the second step S2 has a plurality of sub-step groups each constituting one frame in which part of the first to seventh sub-steps SB1 to SB7 is executed. For example, the first to third sub-steps SB1 to SB3 executed in the frame F2 constitute one sub-step group. The fourth to sixth sub-steps SB4 to SB6 executed in the frame F3 constitute another sub-step group. The seventh sub-step SB7 executed in the frame F4 constitutes another sub-step group.

As shown in FIG. 11, the execution of the first step S1 requires one frame (frame F1). Therefore, in the present embodiment, four frames in total, i.e., the frame F1 for the first step S1 and the frames F2 to F3 for the second step S2 are required to write a desired grayscale at a predetermined pixel.

As will be detailed later, at the second step S2, any of the grayscales at levels "0" to "15" may be written by sequentially executing the first sub-step SB 1 through the seventh sub-step SB7 to apply voltage pulses to the liquid crystals. Any of the grayscales at levels "0" to "15" may alternatively be written by executing the seven sub-steps SB1 to SB7 in respective frames different from each other to scan the scan electrode seven times. However, flickers on the display screen can be made less noticeable by executing the plurality of sub-steps collectively in one frame as in the present embodiment than scanning the scan electrode seven times. The embodiment is also preferable in that instantaneous power of the liquid crystal display element 1 can be small.

When a plurality of sub-steps among the sub-steps SB1 to SB7 is collectively executed in one frame, there is a reduction in scan speed. It is therefore preferable to keep the number of frames collectively constituted by sub-steps SB1 to SB7 reasonably small. It is convenient for a user to have understanding of displayed content at an early stage. In order to save power consumed by the liquid crystal display element 1, it is advantageous to execute writing by integrating the first to seventh sub-steps SB1 to SB7 into one frame. However, the scan speed becomes lower, the higher the level of integration of the sub-steps. As a result, it takes a longer time for a user to understand display content which has been updated.

When an excessively great number of bit planes are collectively processed, one scan electrode will be engaged in the process for a long time, and there will be a smaller margin for cross-talks. For example, when the first to seventh sub-steps SB1 to SB7 in FIG. 11 are integrated into one frame, the scan speed will be about 14 ms/line. Further, a voltage of ±10 V will be applied to half-selected pixels for a longer time. As a result, the display screen becomes more vulnerable to cross-talks which can reduce brightness.

For the above-described reasons, the seven sub-steps SB1 to SB7 of the second step S2 are divided into three frames F2 to F4 in the present embodiment. Thus, the liquid crystal display element 1 can be well-balanced in terms of the relationship between the suppression of flickers on the display screen and power consumption and high display speed to be achieved. Even in the first frame F2 following the full screen reset at the first step S1, 512 colors consists of 8 grayscales of each of R, G, and B are written to allow a user to have understanding of displayed content at an early stage. The number of sub-steps integrated into one frame is not limited to that in the present embodiment, and an optimal number of sub-steps may be integrated according to the characteristics of a liquid crystal display element.

The second step S2 of the method of driving the liquid crystal display element 1 will now be described in more detail. In the present embodiment, a reference grayscale is set at grayscale level 8. Let us assume that a term "cumulative time difference" means a difference between a cumulative voltage application time of voltage pulses cumulatively applied to display a grayscale lower than an initial grayscale and a cumulative voltage application time of voltage pulses cumulatively applied to display a grayscale one level lower than the grayscale that is lower than the initial grayscale. Then, as shown at the bottom of FIG. 11, cumulative time differences between low grayscales lower than the reference grayscale (grayscale level "8") are 1.5 ms, and cumulative time differences between high grayscales equal to or higher than the reference grayscale (grayscale level "8") are 0.5 ms. As thus described, cumulative time differences between low grayscales are longer than cumulative time differences between high grayscales at the second step S2 in the present embodiment.

For example, the cumulative voltage application time for the grayscale 7 included in the low grayscales is 4.0 ms, and the cumulative voltage cumulative time for the grayscale of level "6" that is one level lower than the grayscale of level "7" is 5.5 ms. Therefore, the cumulative time difference between the grayscale of level "7" and the grayscale of level "6" is 1.5 ms. On the contrary, the cumulative voltage application time for the grayscale of level "14" included in the high grayscales is 0.5 ms, and the cumulative voltage cumulative time for the grayscale of level "13" that is one level lower than the grayscale of level "14" is 1.0 ms. Therefore, the cumulative time difference between the grayscale of level "14" and the grayscale of level "13" is 0.5 ms. In the present embodiment, the cumulative time differences between the low grayscales are three times the cumulative time differences between the high grayscales. As shown in FIGS. 7B and 7C, even when voltage pulses having equal voltage values are applied, the reflectance of a liquid crystal decreases in a great amount if the pulse widths of the voltage pulses increases. Therefore, grayscale display can be sufficiently performed even for low grayscales which have low response to voltage pulses as shown in FIG. 5.

FIG. 12 shows voltage values of voltages output by the scan electrode driving circuit 25 and the data electrode driving circuit 27 at the second step S2 and voltage values of voltage pulses applied to the B, G, and R liquid crystal layers 3*b*, 3*g*, and 3*r* provided at the B, G, and R display sections 6*b*, 6*g*, and 6*r* respectively. The term "selection period" shown in FIG. 12 corresponds to "ON" shown in FIG. 11.

First, a description will be made on a case in which a desired grayscale is at any of levels "8" to "15" which are on the high grayscale side. Referring to FIG. 5, since the cholesteric liquid crystals have high response to voltage pulses on the high grayscale side, voltage pulses are applied to the cholesteric liquid crystals such that there will be cumulative time differences of, for example, 0.5 ms.

As shown in FIG. 11, the grayscale of the pixel is the level "15" when the first step S1 is finished. When the desired grayscale is the level "15", there is no need for lowering the grayscale level at the second step S2. Therefore, as shown in the rightmost column of FIG. 11, the pixel is in a non-selection period throughout the second step S2. As shown in FIG. 12, in order to put a predetermined pixel in a non-selected state, the output voltage of the data electrode driving circuit 27 and the output voltage of the scan electrode driving circuit 25 have voltage values of +20 V and +10 V, respectively, in about the first half of their pulse periods. In about the second half of the pulse periods, the output voltage of the data electrode driving circuit 27 has a voltage value of 0 V, whereas the output voltage of the scan electrode driving circuit 25 has a voltage value of +10 V. Therefore, a voltage of ±10 V is applied to the liquid crystals. Since the voltage applied to the cholesteric liquid crystals is low, the B, G, and R liquid crystal layers 3*b*, 3*g*, and 3*r* maintain the present grayscale as shown in FIG. 7B. Thus, a voltage of ±10 V is applied to the B-pixel 12*b* (1,1) to keep it in the planar state throughout the second step S2.

When the desired grayscale is the level "14", the third sub-step SB3 at which the voltage pulses have a pulse width of 0.5 ms constitutes a selection period, and the other sub-steps constitute non-selected periods. As a result, as shown in the second column from the right side of FIG. 11, the cumulative voltage application time of the pixel is 0.5 ms, and there is a cumulative time difference of 0.5 ms. Therefore, the grayscale of level "14" that is one level lower than level "15" is displayed at the B pixel 12*b* (1,1). In order to put a predetermined pixel in a selected state, as shown in FIG. 12, the output voltage of the data electrode driving circuit 27 and the output voltage of the scan electrode driving circuit 25 have voltage values of +20 V and 0 V, respectively, in about the first half of their pulse periods. In about the second half of the pulse periods, the output voltage of the data electrode driving circuit 27 has a voltage value of 0 V, whereas the output voltage of the scan electrode driving circuit 25 has a voltage value of +20 V. Therefore, a voltage of ±20 V is applied to the liquid crystals.

As shown in the third column from the right side of FIG. 11, the second sub-step SB2 at which the voltage pulses have a pulse width of 1 ms constitutes a selection period, and the other sub-steps constitute non-selection periods to display the grayscale of level "13" at the B pixel 12*b* (1,1). Thus, the cumulative voltage application time of the pixel is 1.0 ms, and there is a cumulative time difference of 0.5 ms. Therefore, the grayscale of level "13" that is one level lower than level "14" is displayed at the B pixel 12*b* (1,1).

As shown in the fourth column from the right side of FIG. 11, to display the grayscale of level "12" at the B pixel 12*b* (1,1), the second and third sub-steps SB2 and SB3 at which the voltage pulses have pulse widths of 1 ms and 0.5 ms, respectively, constitute selection periods, and the other sub-steps constitute non-selection periods. Thus, the cumulative voltage application time of the pixel is 1.5 ms, and there is a cumulative time difference of 0.5 ms. Therefore, the grayscale of level "12" that is one level lower than level "13" is displayed at the B pixel 12*b* (1,1).

As shown in the fifth column from the right side of FIG. 11, to display the grayscale of level "11" at the B pixel 12*b* (1,1), the first sub-step SB1 at which the voltage pulses have a pulse width of 2 ms constitutes a selection periods, and the other sub-steps constitute non-selection periods. Thus, the cumulative voltage application time of the pixel is 2.0 ms, and there is a cumulative time difference of 0.5 ms. Therefore, the grayscale of level "11" that is one level lower than level "12" is displayed at the B pixel 12*b* (1,1).

As shown in the sixth column from the right side of FIG. 11, to display the grayscale of level "10" at the B pixel 12*b* (1,1), the first and third sub-steps SB1 and SB3 at which the voltage pulses have pulse widths of 2 ms and 0.5 ms, respectively, constitute selection periods, and the other sub-steps constitute non-selection periods. Thus, the cumulative voltage application time of the pixel is 2.5 ms, and there is a cumulative time difference of 0.5 ms. Therefore, the grayscale of level "10" that is one level lower than level "11" is displayed at the B pixel 12*b* (1,1).

As shown in the seventh column from the right side of FIG. 11, to display the grayscale of level "9" at the B pixel 12*b* (1,1), the first and second sub-steps SB1 and SB2 at which the voltage pulses have pulse widths of 2 ms and 1 ms, respectively, constitute selection periods, and the other sub-steps constitute non-selection periods. Thus, the cumulative voltage application time of the pixel is 3.0 ms, and there is a cumulative time difference of 0.5 ms. Therefore, the grayscale of level "9" that is one level lower than level "10" is displayed at the B pixel 12*b* (1,1).

As shown in the eighth column from the right side of FIG. 11, to display the grayscale of level "8" at the B pixel 12*b* (1,1), the first to third sub-steps SB1 to SB3 at which the voltage pulses have pulse widths of 2.0 ms, 1.0 ms, and 0.5 ms, respectively, constitute selection periods, and the other sub-steps constitute non-selection periods. Thus, the cumulative voltage application time of the pixel is 3.5 ms, and there is a cumulative time difference of 0.5 ms. Therefore, the grayscale of level "8" that is one level lower than level "9" is displayed at the B pixel 12*b* (1,1).

A description will now be made on a case in which a desired grayscale is at any of levels "7" to "0" which are on the low grayscale side. Referring to FIG. 5, since the cholesteric liquid crystals have low response to voltage pulses on the low grayscale side, voltage pulses are applied to the cholesteric liquid crystals such that there will be cumulative time differences of, for example, 1.5 ms.

When the desired grayscale is level "7", the first to fourth sub-steps SB1 to SB4 at which the voltage pulses have pulse widths of 2.0 ms, 1.0 ms, 0.5 ms, and 0.5 ms, respectively, constitute selection periods, and the other sub-steps constitute non-selection periods. As a result, as shown in the ninth column from the right side of FIG. 11, the cumulative voltage application time of the pixel is 4.0 ms, and, the grayscale of level "7" can be displayed at the B pixel 12*b* (1,1). The fourth sub-step SB4 is provided at the boundary between the high grayscale side and the low grayscale side to make the grayscale of level "8" and the grayscale of level "7" different from each other in brightness. The primary purpose of the cumulative time difference provided at the boundary between the high grayscale side and the low grayscale side (the boundary lies between the grayscale of level "8" and the grayscale of level "7") is to provide a difference in brightness between the lowest grayscale on the high grayscale side and the highest grayscale on the low grayscale side. Therefore, the cumulative time difference is not required to be equal to the cumulative time differences on the high grayscale side as in the present embodiment. The cumulative time difference at such a boundary may be determined based on the response of a liquid crystal of interest to voltage pulses.

As shown in the tenth column from the right side of FIG. 11, to display the grayscale of level "6" at the B pixel 12*b* (1,1), the first to fourth sub-steps SB1 to SB4 and the sixth sub-step SB6 at which the voltage pulses have pulse widths of 2.0 ms, 1.0 ms, 0.5 ms, 0.5 ms, and 1.5 ms, respectively, constitute selection periods, and the other sub-steps constitute non-selection periods. Thus, the cumulative voltage application time of the pixel is 5.5 ms, and there is a cumulative time difference of 1.5 ms. Therefore, the grayscale of level "6" that is one level lower than the level "7" is displayed at the B pixel 12*b* (1,1).

As shown in the eleventh column from the right side of FIG. 11, to display the grayscale of level "5" at the B pixel 12*b* (1,1), the first to fifth sub-steps SB1 to SB5 at which the voltage pulses have pulse widths of 2.0 ms, 1.0 ms, 0.5 ms, 0.5 ms, and 3.0 ms, respectively, constitute selection periods, and the other sub-steps constitute non-selection periods. Thus, the cumulative voltage application time of the pixel is 7.0 ms, and there is a cumulative time difference of 1.5 ms. Therefore, the grayscale of level "5" that is one level lower than the level "6" is displayed at the B pixel 12*b* (1,1).

As shown in the twelfth column from the right side of FIG. 11, to display the grayscale of level "4" at the B pixel 12*b* (1,1), the first to sixth sub-steps SB1 to SB6 at which the voltage pulses have pulse widths of 2.0 ms, 1.0 ms, 0.5 ms, 0.5 ms, 3.0 ms, and 1.5 ms, respectively, constitute selection periods, and the other sub-steps constitute non-selection periods. Thus, the cumulative voltage application time of the pixel is 8.5 ms, and there is a cumulative time difference of 1.5 ms. Therefore, the grayscale of level "4" that is one level lower than the level "5" is displayed at the B pixel 12*b* (1,1).

As shown in the thirteenth column from the right side of FIG. 11, to display the grayscale of level "3" at the B pixel 12*b* (1,1), the first to fourth sub-steps SB1 to SB4 and the seventh sub-step SB7 at which the voltage pulses have pulse widths of 2.0 ms, 1.0 ms, 0.5 ms, 0.5 ms, and 6.0 ms, respectively, constitute selection periods, and the other sub-steps constitute non-selection periods. Thus, the cumulative voltage application time of the pixel is 10.0 ms, and there is a cumulative time difference of 1.5 ms. Therefore, the grayscale of level "3" that is one level lower than the level "4" is displayed at the B pixel 12*b* (1,1).

As shown in the fourteenth column from the right side of FIG. 11, to display the grayscale of level "2" at the B pixel 12*b* (1,1), the first to fourth sub-steps SB1 to SB4 and the sixth and seventh sub-steps SB6 and SB7 at which the voltage pulses have pulse widths of 2.0 ms, 1.0 ms, 0.5 ms, 0.5 ms, 1.5 ms, and 6.0 ms, respectively, constitute selection periods, and the other sub-steps constitute non-selection periods. Thus, the cumulative voltage application time of the pixel is 11.5 ms, and there is a cumulative time difference of 1.5 ms. Therefore, the grayscale of level "2" that is one level lower than the level "3" is displayed at the B pixel 12*b* (1,1).

As shown in the fifteenth column from the right side of FIG. 11, to display the grayscale of level "1" at the B pixel 12*b* (1,1), the first to fifth sub-steps SB1 to SB5 and the seventh sub-step SB7 at which the voltage pulses have pulse widths of 2.0 ms, 1.0 ms, 0.5 ms, 0.5 ms, 3.0 ms, and 6.0 ms, respectively, constitute selection periods, and the other sub-steps constitute non-selection periods. Thus, the cumulative voltage application time of the pixel is 13 ms, and there is a cumulative time difference of 1.5 ms. Therefore, the grayscale of level "1" that is one level lower than the level "2" is displayed at the B pixel 12*b* (1,1).

As shown in the leftmost column in FIG. 11, to display the grayscale of level "0" at the B pixel 12*b* (1,1), all of the sub-steps SB1 to SB7 constitute selection periods. Thus, the cumulative voltage application time of the pixel is 14.5 ms, and there is a cumulative time difference of 1.5 ms. Therefore, the grayscale of level "0" that is one level lower than the level "1" is displayed at the B pixel 12*b* (1,1).

When voltage pulses are cumulatively written from the high grayscale side to the low grayscale side as shown in FIG. 5, it is difficult to achieve high response of liquid crystals on the low grayscale side if voltage pulses having great pulse widths are first applied and voltage pulses having smaller pulse widths are applied thereafter. Under the circumstance, at the second step S2 of the present embodiment, relatively high grayscales (levels "8" to "15") on the high grayscale side are displayed at the pixel prior to relatively low grayscales (levels "0" to "7") on the low grayscale side. As shown in FIG. 11, the display of the grayscales of levels "8" to "15" is completed when the first to third sub-steps SB1 to SB3 have been finished. The display of the grayscales of levels "0" to "7" is completed at the sub-step SB4 and sub-steps subsequent thereto.

Figure 13:
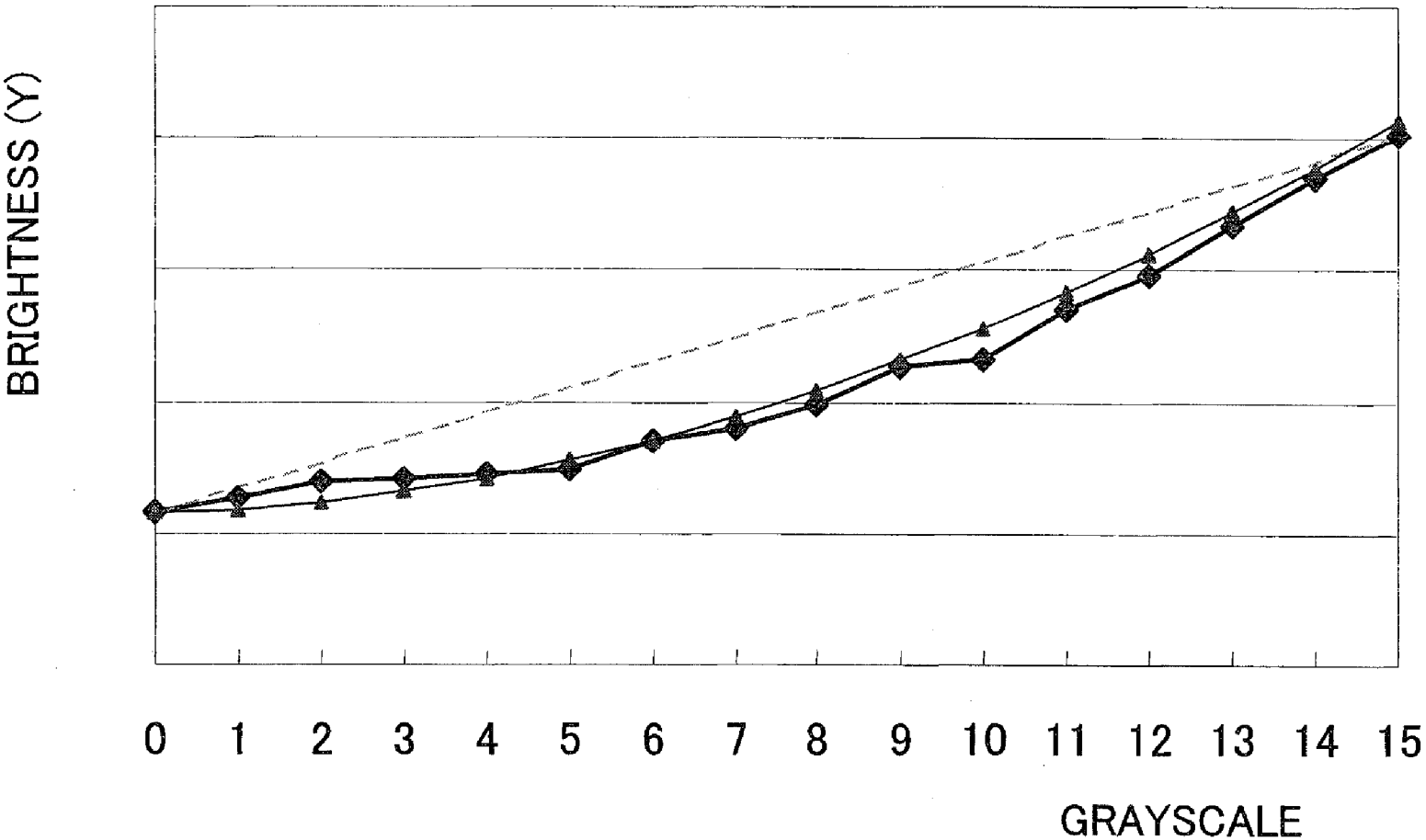
FIG. 13 shows a grayscale curve of the liquid crystal display element 1 according to the embodiment of the invention.

FIG. 13 shows a grayscale curve of 16 monochromatic grayscales displayed by the liquid crystal display element 1 of the present embodiment. The horizontal axis represents grayscales, and the vertical axis represents brightness (Y). The grayscale curve of the liquid crystal display element 1 is represented by the curve connecting black rhombic symbols, and the curve connecting black triangular symbols represents an approximated curve of the grayscale curve obtained with a gamma value of 0.54. As shown in FIG. 13, a preferable grayscale curve without grayscale jumps is obtained from the liquid crystal display element 1. The grayscale curve of the liquid crystal display element 1 is approximated with a gamma value of 0.54. Therefore, a linear grayscale curve represented by a broken line in the figure can be obtained by performing a gamma correction on the image data using the inverse of 0.54 (≈1.85). The grayscale curve thus obtained varies to some extent depending on the material and configuration of the display element.

An example of the method of manufacturing the liquid crystal display element 1 will now be briefly described.

ITO transparent electrodes are formed on two polycarbonate (PC) film substrates cut in longitudinal and transverse dimensions of 10 (cm)×8 (cm). Etching is then performed to pattern the electrodes to form electrodes (scan electrodes 17 and data electrodes 19) in the form of stripes having a pitch of 0.12 mm on the substrates, respectively. The electrodes in the form of stripes are formed on the two respective PC film substrates to allow VGA display with 640×480 dots. A polyimide type alignment film material is applied to a thickness of about 700 Å using a spin coat process on each of the transparent electrodes 17 and 19 in the form of stripes on the two PC film substrates 7 and 9. Next, the two PC film substrates 7 and 9 having the alignment film material thus applied are baked for one hour in an oven at 90° C. to form alignment films. Then, an epoxy type seal material 21 is applied to a peripheral part of either PC film substrate 7 or 9 using a dispenser to form a wall having a predetermined height.

Next, spacers having a diameter of 4 μm (manufactured by Sekisui Fine Chemical Co., Ltd) are dispersed on the other PC film substrate, i.e., the substrate 9 or 7. The two PC film substrates 7 and 9 are then combined and heated for one hour at 160° C. to cure the sealing material 21. Next, a cholesteric liquid crystal LCb for blue is injected using a vacuum injection process, and the injection port is thereafter sealed with an epoxy type sealant. Thus, a B display section 6*b* is fabricated. A G display section 6*g* and an R display section 6*r* are fabricated using the same method.

Next, as shown in FIG. 2, the B, G, and R display sections 6*b*, 6*g*, and 6*r* are stacked in the order listed from the side of a display surface of the element. Next, a visible light absorbing layer 15 is disposed on a back side of a lower substrate 9*r* of the R display section 6*r*. Then, general-purpose STN driver ICs having a TCP (tape carrier package) structure are press-fit to terminal portions of the scan electrodes 17 and the data electrodes 19 of the B, G, and R display sections 6*b*, 6*g*, and 6*r* thus stacked, and a power supply circuit and a control circuit section 23 are further connected. Thus, a liquid crystal display element 1 capable of VGA display is completed. Although not shown, an input/output unit and a control unit for controlling the element as a whole (neither of the units is shown) are provided on the liquid crystal display element 1 to complete an electronic paper. Further, a display system is configured using the electronic paper.

Figure 14:
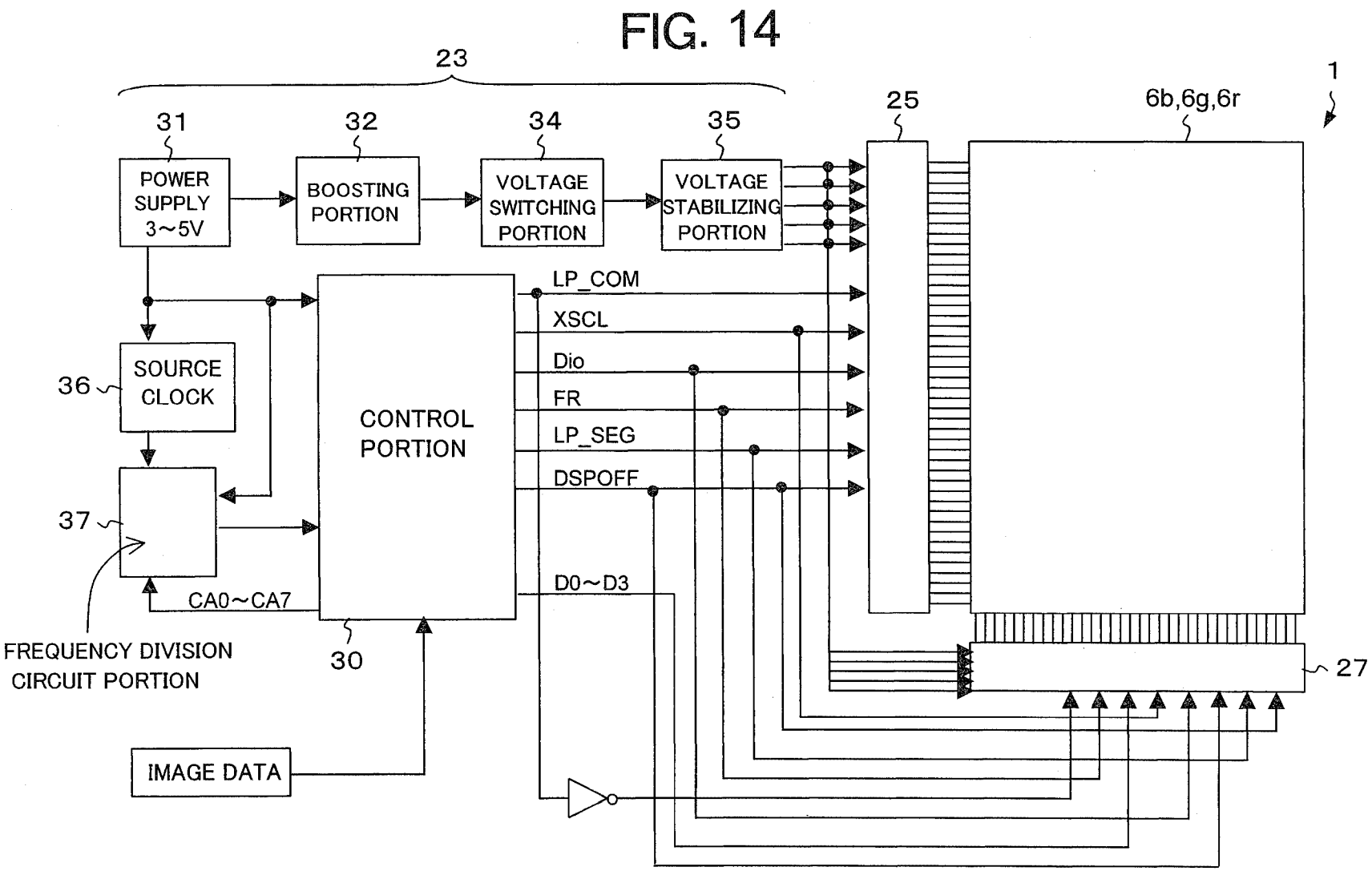
FIG. 14 shows a schematic configuration of the liquid crystal display element 1 according to the embodiment of the invention.

An embodiment of a driving unit including the control circuit section 23 according to the present embodiment will now be described with reference to FIGS. 14 and 15. FIG. 14 schematically illustrates the configuration shown in FIG. 1 and shows a configuration of major circuits of the control circuit section 23 which is shown as a block in FIG. 1.

The control circuit section 23 includes a control portion 30 which outputs image data to the data electrode driving circuit 27 at predetermined timing and outputs various control data to the scan electrode driving circuit 25 and the data electrode driving circuit 27, the image data being obtained by converting full-color image data (original image) input from the outside using a predetermined grayscale conversion technique to make the data suitable for the first and second steps S1 and S2. Specifically, the image data output to the scan electrode driving circuit 25 and the data electrode driving circuit 27 are obtained by converting the grayscales of the full-color original image into 4096 values using the error diffusion method. The grayscale conversion may be performed using the blue noise mask method which is a preferable alternative to the error diffusion method from the viewpoint of display quality. The driving unit includes an image converting part (not shown) for performing grayscale conversion of the image data input from the outside to split and convert the data. The image converting part may be provided at the control portion 30 instead of providing it in the control circuit section 23 separately. The image converting part may perform grayscale conversion after a gamma correction as described with reference to FIG. 13 is carried out on the image data.

The control portion 30 outputs signals to the electrode driving circuits 25 and 27 as occasion demands, the signals including a data fetch clock XSCL indicating timing for fetching image data, a frame start signal Dio which is a synchronization signal for starting writing of one display screen, a latch pulse LP_SEG for latching image data at the data electrode driving circuit 27, a shift pulse LP_COM used as a scan signal for selecting a predetermined scan electrode by shifting the scan electrode sequentially, grayscale-converted image data D0 to D3, a polarity inversion signal FR for inverting the polarity of a voltage pulse applied to a liquid crystal, and a voltage turn-off signal /DSPOF for forcibly connecting the output of the electrode driving circuits 25 and 27 to the ground. Further, the control portion 30 outputs the scan speed of a scan electrode, i.e., bit arrays CA0 to CA7 which determine pulse widths of voltage pulses at the substeps to a frequency division circuit 37.

Driving voltages input to the scan electrode driving circuit 25 or the data electrode diving circuit 27 are obtained by boosting a logical voltage of 3 to 5 V output from a power supply portion 31 to 36 to 40 V at a boosting portion 32 having a regulator such as a DC-DC converter and supplying the resultant voltage through a voltage switching portion 34 to a voltage stabilizing portion 35, whereby forming the voltage into various voltage outputs through resistive voltage division. The voltage outputs obtained at the voltage stabilizing portion 35 are voltages of 36 V, 20 V, 10 V, and 0 V used at the first and second steps S1 and S2. Based on the image data output from the control portion 30, the scan electrode driving circuit 25 and the data electrode driving circuit 27 select any of the plurality of voltage values output from the voltage stabilizing portion 35. The power supply portion 31 supplies predetermined power to the control portion 30, a source clock portion 36, and a frequency division circuit portion 37 in addition to the boosting portion 32.

The voltage stabilizing portion 35 may include a product named Max 4535 having a withstand voltage of 40 V manufactured by Maxim Integrated Products, Inc. as an analog switch for switching between pulse voltages used at the first step S1 and the second step S2. An operational amplifier to serve as a voltage follower is preferably provided downstream of the analog switch to stabilize the voltages input to the drivers. It is more preferable to use an operational amplifier of a type that is tolerant of a capacitive load such as a liquid crystal element. Further, a rail-to-rail operational amplifier is preferable from the viewpoint of power saving because a power supply voltage can be equal to an output voltage. As a result, at the first step S1, a pulse voltage of ±36 V can be stably applied to the liquid crystals during a selection period, and a voltage of 0 V can be stably applied in a non-selection period. At the second step S2, a pulse voltage of ±20 V can be stably applied to the liquid crystals during a selection period, and a voltage of ±10 V can be stably applied in a non-selection period.

In order to switch scanning speed, there is provided a frequency division circuit portion 37 to which a clock output from the source clock portion 36 is input and which provides outputs obtained by performing frequency division on the clock in predetermined frequency division ratios. Bit arrays CA0 to CA7 for controlling the scanning speed are input to the frequency division circuit portion 37 from the control portion 30, and the frequency division ratio of a counter for controlling the scanning speed is changed according to the values of the bit arrays CA0 to CA7. Specifically, an initial value of a frequency division counter (not shown) provided in the frequency division circuit portion 37 may be switched at each scan. In the present embodiment, since it is required at the first step S1 and the second step S2 to switch the initial value of the frequency-division counter in seven steps in total, the number of bits of the bit arrays CA0 to CA7 required for pulse width switching is three. In order to achieve stable display at a wide range of temperatures, the values of the bit arrays CA0 to CA7 are preferably associated with ambient temperatures.

Timing for driving the liquid crystal display element 1 according to the present embodiment will now be described with reference to FIG. 15. FIG. 15 is an example of a timing chart of the liquid crystal display element 1. Referring to FIG. 15, the eight kinds of control signals output from the above-described control portion 30 to the electrode driving circuits 25 and 27 are sequentially shown from the top of the figure, and timing of screen outputs or timing at which the scan electrodes are scanned is shown at the bottom. The lapse of time is shown in the left-to-right direction of the figure, and voltage levels are represented in the vertical direction of the figure.

Figure 15:
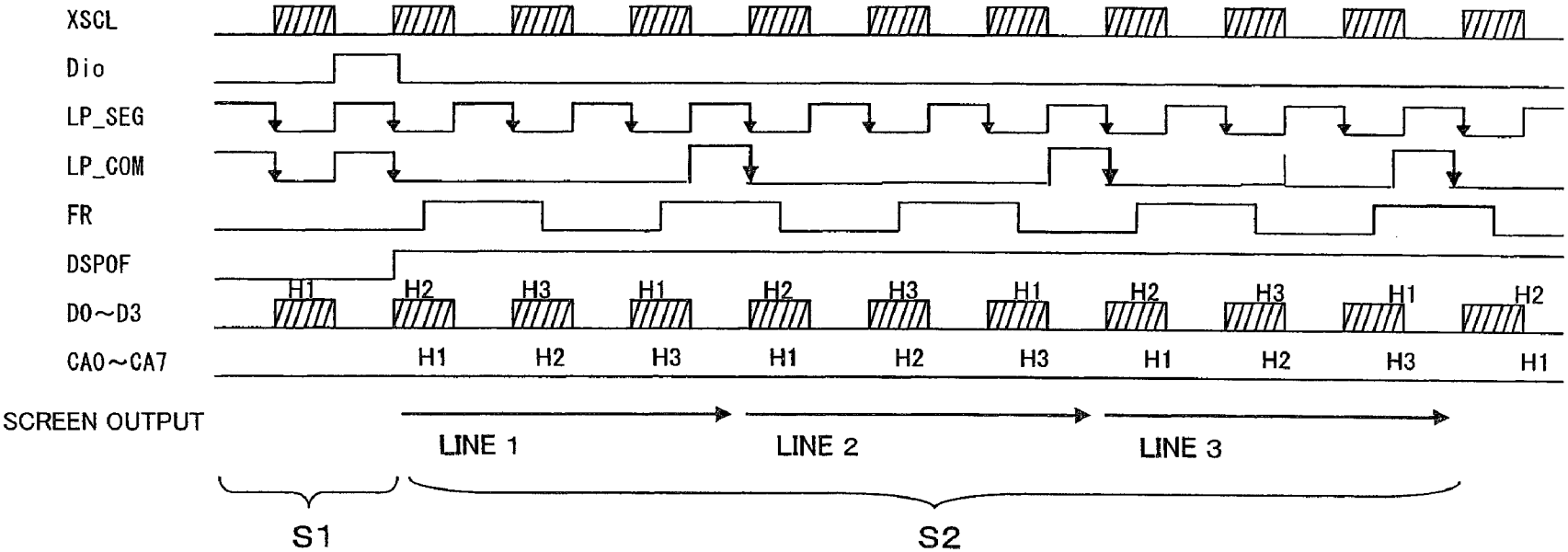
FIG. 15 is a driving timing chart of the liquid crystal display element 1 according to the embodiment of the invention.

As shown in FIG. 15, when the first step S1 is completed according to the above-described method in which a voltage pulse having a voltage value of ±36 V and a pulse width of, for example, 100 ms is applied to the cholesteric liquid crystals at all pixels to initialize them into the planar state, the voltage turn-off signal /DSPOF and the frame start signal Dio rise to a high level. As a result, the second step S2 is started. The image data D0 to D3 which have been converted into 4096 colors are input to the data electrode driving circuit 27 for each of R, G, and B before the voltage turn-off signal /DSPOF and the frame start signal Dio rise to the high level. The image data D0 to D3 for four columns are sequentially input to the data electrode driving circuit 27 in synchronism with the data fetch clock XSCL. For example, in the case of a write utilizing cumulative response, the image data in 4096 colors (16 grayscales of each of R, G, and B) are split into binary image data H1 to H7 associated with intermediate grayscales to write the image data according to the driving conditions shown in FIG. 11. Voltage pulses based on the binary image data H1 to H7 are output to the data electrodes in synchronism with falling edges of the latch pulse LP_SEG.

In the present embodiment, as shown in FIG. 11 when the first step S1 is finished, three sub-steps are integrated into one frame. Therefore, the data electrode driving circuit 27 repeatedly outputs voltage pulses based on image data to a predetermined scan electrode three times and drives subsequent scan electrodes similarly. Thus, the data electrode driving circuit 27 repeatedly outputs voltage pulses of the image data H1 to H3 to a line 1 which is a scan electrode, and the circuit drives lines 2 and 3 similarly. A voltage pulse of ±20 V is applied to a pixel whose grayscale level is to be changed, and a voltage as low as ±10 V to which a liquid crystal does not respond is applied to a pixel whose grayscale level is to be kept unchanged. The pulse widths of the voltage pulses are controlled by the bit arrays CA0 to CA7. The polarity of a voltage pulse is inverted by inverting the polarity inversion signal FR at a point in time substantially in the middle of the application time of the voltage pulse.

The shift pulse LP_COM is output to the scan electrode driving circuit 25 once per three clocks of the latch pulse LP_SEG such that voltage pulses can be output to the same row three times repeatedly. Thus, the 1st to 480th rows are sequentially scanned, and the first to third sub-steps SB1 to SB3 of the second step S2 are terminated. When the scan is completed up to the 480th row, the fourth to seventh sub-steps SB4 to SB7 are executed at similar timing for driving to display an image having 16 grayscales on the display screen of the liquid crystal display element 1. As shown in FIG. 14, the liquid crystal display element 1 can rewrite the screen in about 1.6 seconds in a draft mode which will be described later and in a total time of 6.7 seconds when 4096 colors are displayed at the normal timing for driving using an inexpensive circuit configuration using general-purpose STN drivers.

As described above, according to the present embodiment, a display element using cholesteric liquid crystals can be driven to perform multi-grayscale display of high display quality without blurs, ghosts, and grayscale jumps at low grayscales even when inexpensive general-purpose STN drivers providing binary outputs are used. Further, the liquid crystal display element 1 of the present embodiment is capable of display rewriting in a short time.

A method of driving a liquid crystal display element according to Modification 1 of the present embodiment will now be described. The liquid crystal display element of the present modification has a configuration similar to that of the liquid crystal display element 1 shown in FIGS. 1 and 14. Therefore, the configuration of the liquid crystal display element and an electronic paper having the same will not be described. The liquid crystal display element of the present modification is characterized in that a grayscale which is one level higher than an $m/2^n$-th grayscale is set as a reference grayscale where n represents the number of reference grayscales to be set and m represents the number of grayscales to be displayed at a pixel and in that cumulative time differences on both sides of the reference grayscale serving as a boundary are different from each other. The liquid crystal display element of the present modification is also characterized in that the cumulative number of applications of voltage pulses within a range in which cumulative time differences are equal to each other is given by $\log_2 t$ where t represents the number of grayscales included in the range (a power of 2).

In the liquid crystal display element 1 of the above-described embodiment, cumulative time differences are switched at grayscale level 8 which is in the middle of 16 grayscales. However, when pulses on the low grayscale side have response lower than the characteristics shown in FIG. 5, voltage pulses for grayscale levels 15 to 8, voltage pulses for grayscale levels 7 to 4, and voltage pulses for grayscale levels 3 to 0 may have pulse widths of 1, 2, and 4, respectively. When pulse widths are switched between grayscale ranges where the number of grayscales of each range is a power of 2 as thus described, the number of pulses required to provide different grayscales can be made smaller, and the amount of data processed at the control circuit section 23 can be reduced.

Figure 16:
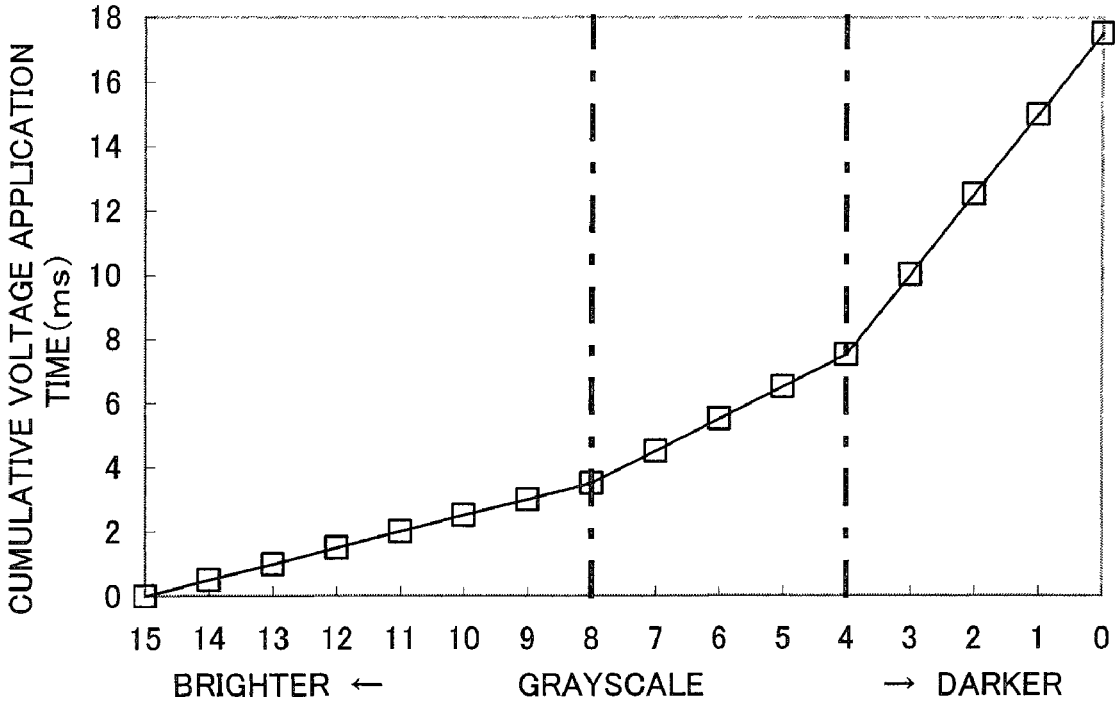
FIG. 16 is a graph showing a relationship between grayscales of a liquid crystal display element according to Modification 1 of the embodiment of the invention and cumulative voltage application times.

FIG. 16 is a graph showing a relationship between grayscales of the liquid crystal display element of the present modification and cumulative voltage application times. The horizontal axis represents grayscales, and the vertical axis represents cumulative voltage application times (ms). Reference grayscales are represented by the straight chain lines. In the present modification, the grayscales of level "8" and level "4" constitute reference grayscales.

In the case of the liquid crystal display element 1 shown in FIG. 6, the number of grayscales m is 16; the number of reference grayscales n is 1; the number of grayscales t is 8 on the high grayscale side where cumulative time differences are equal to each other; and the number of grayscales t is 8 on the low grayscale side similarly. Therefore, in the liquid crystal display element 1 shown in FIG. 6, level "8" which is one step higher than the grayscale (level "7") in the eighth ($m/2^n=16/2^1=8$) place counted from the lowest grayscale constitutes a reference grayscale. In the liquid crystal display element 1 shown in FIG. 6, the cumulative number of applications of voltage pluses on each of the high grayscale side and the low grayscale side may be three ($=\log_2 8$). As a result, there is no need for applying voltage pulses 15 times to the liquid crystals of the liquid crystal display element 1 shown in FIG. 6.

In the case of the liquid crystal display element of the present modification, the number of grayscales m is 16; the number of reference grayscales n is 2; and the number of grayscales t is 8 on the high grayscale side where cumulative time differences are equal to each other. Therefore, in the liquid crystal display element 1 of the present modification, level "4" which is one step higher than the grayscale (level "3") in the fourth ($m/2^n=16/2^2=4$) place counted from the lowest grayscale and level "8" which is one step higher than the grayscale (level "7") in the fourth place counted from the grayscale of level "4" constitute reference grayscales. As shown in FIG. 16, the cumulative number of applications of voltage pluses to the liquid crystal display element of the present modification may be 3 ($=\log_2 8$) in the high grayscale region (levels "15" to "8"), 2 ($=\log_2 4$) in the intermediate grayscale region (levels "7" to "4"), and 2 ($=\log_2 4$) in the low grayscale region (levels "3" to "0").

As described above, according to the present modification, even cholesteric liquid crystals exhibiting low pulse response at low grayscales can be driven to achieve multi-grayscale display of high display quality without blurs, ghosts, and grayscale jumps at low grayscales using inexpensive general-purpose STN drivers providing binary outputs. Further, the liquid crystal display element 1 of the present modification is capable of display rewriting in a short time.

A method of driving a liquid crystal display element according to Modification 2 of the present embodiment will now be described. The liquid crystal display element of the present modification has a configuration similar to that of the liquid crystal display element 1 shown in FIGS. 1 and 14. Therefore, the configuration of the liquid crystal display element and an electronic paper having the same will not be described. The liquid crystal display element of the present modification is characterized in that liquid crystals in pixels to be rewritten among the entire pixels of the element are entirely initialized to write an image.

FIGS. 17A to 17C schematically show screens displayed by the liquid crystal display element of the present modification. FIG. 17A shows content displayed on the screen before rewriting. FIG. 17B shows content displayed after the first step S1 is finished. FIG. 17C shows content displayed on the screen after the rewriting is finished (when the second step S2 is finished). For example, let us assume that it is intended to rewrite only the text characters "Kanagawa-Ken" shown in FIG. 17A. In this case, as shown in FIG. 17B, only the region to be rewritten is selected and entirely reset into the planar state at the first step S1. Then, rewriting is performed at the second step S2 only in the region to be partially rewritten with other regions skipped. As a result, only the text characters "Kanagawa-Ken" can be rewritten into text characters "There was an earthquake" as shown in FIG. 17C. It is preferable to skip the regions excluded from the rewriting at the second step S2 by asserting the voltage turn-off function to turn output voltages off because cross-talks can be prevented and a reduction in power consumption can be achieved.

As described above, the present modification provides the same advantages as those of the above-described embodiment. Further, since it is possible to minimize the area of displayed content erased at the time of a reset, an improvement can be achieved in user-friendliness.

A method of driving a liquid crystal display element according to Modification 3 of the present embodiment will now be described with reference to FIGS. 18A to 19. The liquid crystal display element of the present modification has a configuration similar to that of the liquid crystal display element 1 shown in FIGS. 1 and 14. Therefore, the configuration of the liquid crystal display element and an electronic paper having the same will not be described. An electronic paper according to the present modification is characterized in that it has at least two write modes resulting in different states of display. The electronic paper of the present modification has a second step including a first write mode for executing part of a plurality of sub-steps and a second write mode for executing the rest of the plurality of sub-step groups after the execution of the first write mode. Alternatively, the electronic paper of the present modification may have a first write mode for executing part of a plurality of sub-step groups and a re-write mode for re-executing writing from the first step after the execution of the first write mode.

The electronic paper of the present modification can execute a high speed display mode (hereinafter referred to as "draft mode") taking the advantage of the method of driving the liquid crystal display element 1 of the above-described embodiment. In the draft mode, the second step S2 is terminated when the execution of part of a plurality of sub-step groups of the second step S2 is finished. For example, the electronic paper includes a system for stopping the second step S2 at a point in time when a sub-step group constituted by the first to third sub-steps SB1 to SB3 of the second step S2 shown in FIG. 11 has finished writing of image data. In the draft mode, since the second step S2 is terminated when the third sub-step SB3 is finished, an image is pseudo-displayed in 512 colors, which is a state of transition to display in 4096 colors. Thus, the draft mode is advantageous in that displayed content can be recognized at an early stage because an image can be written in a short time, although image quality is lower than that achievable in the normal operation. Further, the displayed content can be sufficiently recognized even from the 512 colors. A user of the electronic paper having the draft mode can update displayed content one item after another just like leafing through a book.

Figure 18B:
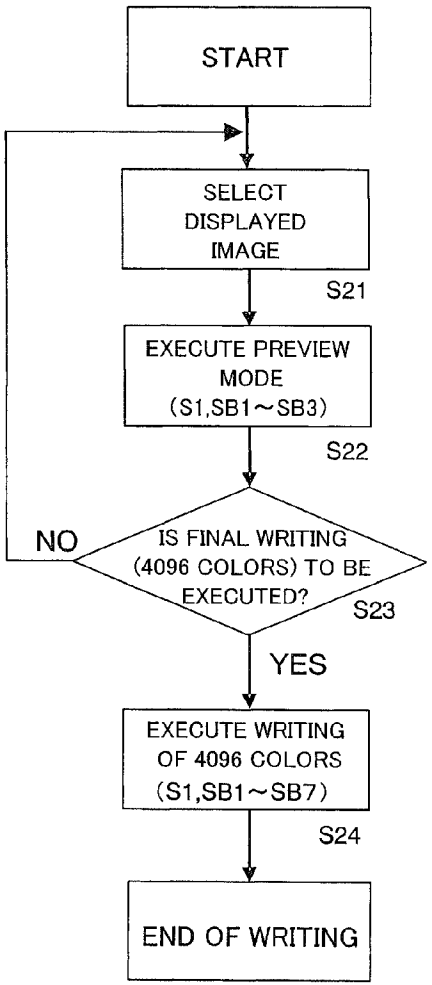
FIGS. 18A and 18B are flow charts of an electronic paper according to Modification 3 of the embodiment of the invention.
Figure 18A:
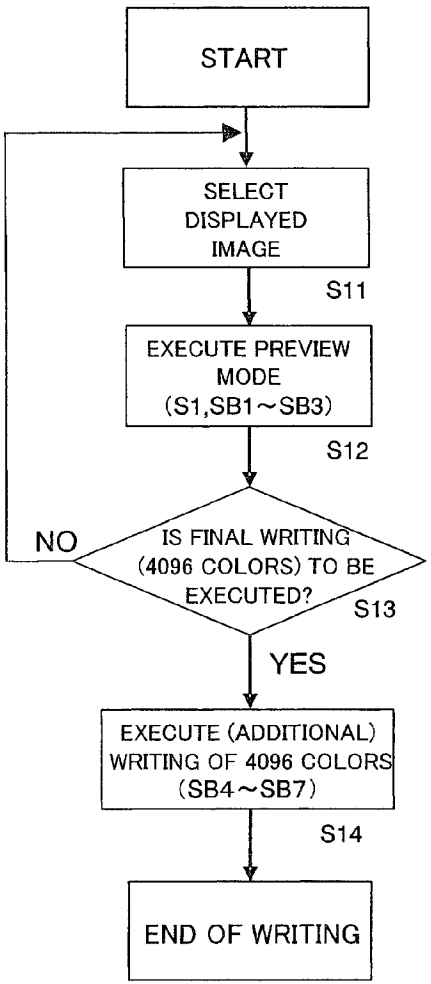

FIGS. 18A and 18B are flow charts of methods of driving electronic paper according to the present modification. FIG. 18A is a flow chart of a method of driving electronic paper using the first draft mode, and FIG. 18B is a flow chart of a method of driving electronic paper using the second draft mode. In the first draft mode, a preview mode is enabled in the state of transition to writing in 4096 colors. In the second draft mode, a preview is enabled at a speed higher than that of the first draft mode. In FIGS. 18A and 18B, the time required for full-screen resetting is calculated at 0.2 s.

As shown in FIG. 18A, according to the method of driving electronic paper using the first draft mode, a displayed image to be rewritten is selected (step S11), and the first step S1 and the first to third sub-steps SB1 to SB3 in the above-described embodiment are executed as a preview mode (step S12). For example, the processing time of the preview mode is 2.7 ms. When final writing of 4096 colors is to be executed after the preview mode (step S13: Yes), the fourth to seventh sub-steps SB4 to SB7 in the above-described embodiment are executed (additional write) (step S14), and terminate the first draft mode. For example, the processing time of the final writing is 8.5 ms. When the final writing of 4096 colors is not executed after the preview mode (step S13: No), the selection of another displayed image to be rewritten is started (step S11).

As shown in FIG. 18B, according to the method of driving electronic paper using the second draft mode, a displayed image to be rewritten is selected (step S21), and the first step S1 and the first to third sub-steps SB1 to SB3 in the above-described embodiment are executed as a preview mode (step S22). For example, the preview mode requires a processing time of 0.9 ms. In the second draft mode, therefore, display quality achieved when the preview mode is finished is lower than that in the first draft mode.

Figure 19:
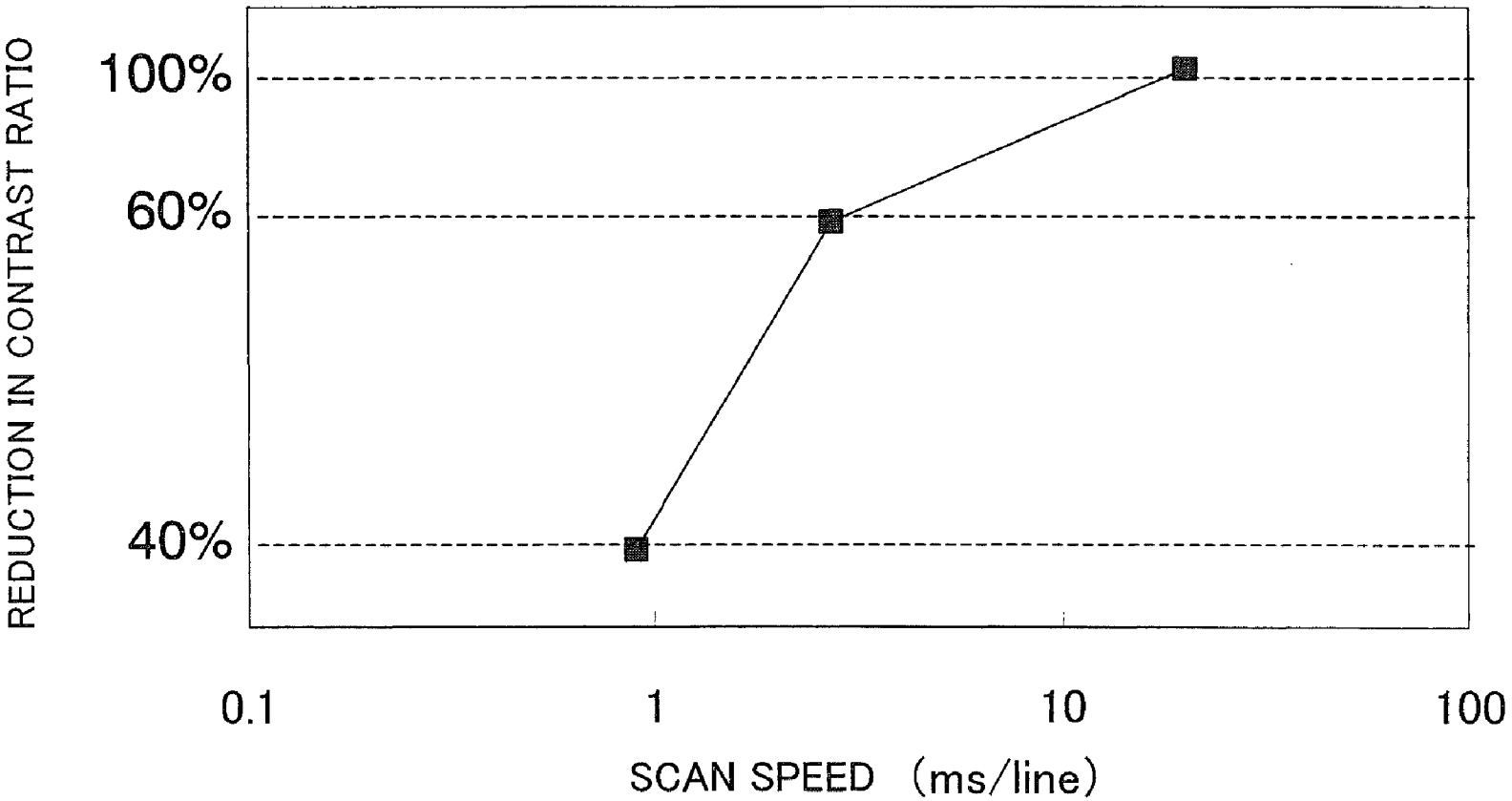
FIG. 19 is a graph showing a relationship between scan speeds of scan electrodes of a liquid crystal display element according to Modification 3 of the embodiment of the invention and reductions in the contrast ratio of the display screen thereof.

FIG. 19 is a graph showing a relationship between scan speeds of the scan electrodes and reductions in the contrast ratio of the display screen. The horizontal axis represents scan speeds (ms/line), and the vertical axis represents reductions in the contrast ratio. FIG. 19 shows scan speed/contrast ratio characteristics observed at a writing voltage of ±18.6 V by way of example. The contrast ratio is the ratio of the brightness (Y-value) of a white display state to that of a black display state. The scan speed is the sum of the pulse widths of voltage pulses applied at the first to third sub-steps SB1 to SB3. The point in the middle of the plot in FIG. 19 is obtained under the driving conditions shown in FIG. 11, the point indicating that a contrast ratio equivalent to 60% of the maximum of the display element can be achieved. The maximum contrast ratio (100%) of the display element can be realized by increasing the writing time with the scan speed reduced. The contrast ratio decreases as the scan speed is increased. The contrast ratio decreases to 40% of the maximum value when the scan speed is increased beyond 1 ms/line that is the same driving condition as for the preview mode of the second draft mode. However, displayed content can be still recognized, and the draft mode sufficiently works.

When the contrast ratio decreases down to 40%, the resultant display quality is insufficient when evaluated as quality obtained from a normal operation. As shown in FIG. 18B, when final writing of 4096 colors is executed after the preview mode in the second draft mode (step S23: Yes), the processes in the above-described embodiment are executed starting with the first step S1, and the second step S2 (the first to seventh sub-steps SB1 to SB7) is executed (additional write) (step S24), and terminate the second draft mode. For example, the processing time of the final writing is 11 ms. When the final writing of 4096 colors is not executed after the preview mode (step S23: No), the selection of another display screen to be rewritten is started (step S21).

In the first draft mode, final writing is executed after the preview mode in the case of the writing condition of 4096 colors. Since only the additional writing at the fourth to seventh sub-steps SB4 to SB7 is therefore executed, the time required for the final writing can be shorten. In the second draft mode, since final writing is carried out starting with full-screen reset (first step S1), the final writing takes a relatively long time.

In the case of the electronic paper which can be driven in the first draft mode, when a user wishes to take a close view of displayed content, the processes at the fourth to seventh sub-steps SB4 to SB7 are executed to perform additional write, whereby the content is displayed in 4096 colors and can therefore be viewed with sufficient image quality. The electronic paper which can be driven in the second draft mode is advantageous in that the draft mode has a higher display speed. Specifically, the speed of the draft mode can be increased by increasing the writing voltage.

Modification 4 of the present embodiment will now be described. A method of driving a liquid crystal display element according to the present modification is characterized in that interlace scanning is used at the second step S2. According to the method of driving a liquid crystal display element of the present modification, the second step S2 may be terminated when a first interlace scan (e.g., scanning of scan electrodes for odd-numbered rows) is finished. For example, when the draft mode in modification 3 is implemented using interlace scanning, the write time can be halved although the contrast ratio is reduced. When the draft mode implemented using interlace scanning is followed by writing of 4096 colors, the writing may be carried out on an interlaced basis.

As described above, the present modification allows a draft mode to be implemented at a higher speed.

What is claimed is:

1. A method of driving a liquid crystal display element comprising:

a first step for initializing a liquid crystal in a pixel and displaying an initial grayscale at the pixel; and a second step for displaying a desired grayscale lower than the initial grayscale by making a cumulative time difference between low grayscales lower than a reference grayscale longer than a cumulative time difference between high grayscales higher than the reference grayscale, where the cumulative time differences are a difference between a cumulative voltage application time of voltage pulses cumulatively applied to display a grayscale lower than the initial grayscale and a cumulative voltage application time of the voltage pulses cumulatively applied to display a grayscale one level lower than the grayscale lower than the initial grayscale.

2. The method of driving a liquid crystal display element according to claim 1, wherein the second step includes a plurality of sub-steps for applying the voltage pulses having equal voltage values and different pulse widths to the liquid crystal.

3. The method of driving a liquid crystal display element according to claim 2, wherein the second step includes a plurality of sub-step groups for executing part of the plurality of sub-steps in one frame.

4. The method of driving a liquid crystal display element according to claim 3, wherein the second step is terminated when the execution of part of the plurality of sub-step groups is finished.

5. The method of driving a liquid crystal display element according to claim 3, wherein a reference voltage is applied to initialize the liquid crystal at the first step.

6. The method of driving a liquid crystal display element according to claim 1, wherein a relatively high grayscale included in the high grayscales is displayed at the pixel prior to a relatively low grayscale included in the low grayscales at the second step.

7. The method of driving a liquid crystal display element according to claim 1, wherein a grayscale which is one level lower than an $m/2^n$-th grayscale is set as the reference grayscale where n represents a number of the reference grayscales to be set and m represents a number of grayscales to be displayed at the pixel and wherein the cumulative time differences on both sides of the reference grayscale serving as a boundary are different from each other.

8. The method of driving a liquid crystal display element according to claim 7, wherein a cumulative number of applications of the voltage pulses within a range in which the cumulative time differences are equal to each other is given by $\log_2 t$ where t represents a number of the grayscales included in the range (t is a power of 2).

9. The method of driving a liquid crystal display element according to claim 1, wherein the initial grayscale is a highest grayscale.

10. A liquid crystal display element comprising:

a liquid crystal enclosed between a pair of substrates;

a pixel including the liquid crystal and a pair of electrodes sandwiching the liquid crystal; and a driving device for displaying a multiplicity of grayscales by performing a first step for initializing the liquid crystal in the pixel and displaying an initial grayscale at the pixel and a second step for displaying a desired grayscale lower than the initial grayscale by making a cumulative time difference between low grayscales lower than a reference grayscale longer than a cumulative time difference between high grayscales higher than the reference grayscale, where the cumulative time differences are a difference between a cumulative voltage application time of voltage pulses cumulatively applied to display a grayscale lower than the initial grayscale and a cumulative voltage application time of the voltage pulses cumulatively applied to display a grayscale one level lower than the grayscale lower than the initial grayscale.

11. The liquid crystal display element according to claim 10, wherein the second step includes a plurality of sub-steps for applying voltage pulses having equal voltage values and different pulse widths to the liquid crystal.

12. The liquid crystal display element according to claim 11, wherein the second step includes a plurality of sub-step groups for executing part of the plurality of sub-steps in one frame.

13. The liquid crystal display element according to claim 12, wherein the driving device terminates the second step when the execution of part of the plurality of sub-step groups is finished.

14. The liquid crystal display element according to claim 10, wherein the driving device displays a relatively high grayscale included in the high grayscales at the pixel prior to a relatively low grayscale included in the low grayscales at the second step.

15. The liquid crystal display element according to claim 10, wherein the driving device sets a grayscale which is one level lower than an $m/2^n$-th grayscale as the reference grayscale where n represents a number of the reference grayscales to be set and m represents a number of grayscales to be displayed at the pixel to make the reference grayscale serves as a boundary between the cumulative time differences different from each other.

16. The liquid crystal display element according to claim 15, wherein the cumulative number of applications of voltage pulses within a range in which cumulative time differences are equal to each other is given by $\log_2 t$ where t represents the number of grayscales included in the range (t is a power of 2).

17. The liquid crystal display element according to claim 10, wherein the initial grayscale is a highest grayscale.

18. The liquid crystal display element according to claim 10, wherein the driving device shorts the pair of electrodes to a reference potential to initialize the liquid crystal at the first step.

19. An electronic paper comprising a liquid crystal display element according to claim 10.

20. The electronic paper according to claim 19, comprising at least two write modes resulting in different states of display.

* * * * *